US010877395B2

(12) United States Patent
Oka et al.

(10) Patent No.: US 10,877,395 B2
(45) Date of Patent: Dec. 29, 2020

(54) DEVELOPING DEVICE, PROCESS CARTRIDGE AND IMAGE FORMING APPARATUS

(71) Applicant: CANON KABUSHIKI KAISHA, Tokyo (JP)

(72) Inventors: Takuya Oka, Yokohama (JP); Yoshihiro Mitsui, Numazu (JP); Shuhei Kawasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/679,488

(22) Filed: Nov. 11, 2019

(65) Prior Publication Data

US 2020/0150556 A1 May 14, 2020

(30) Foreign Application Priority Data

Nov. 14, 2018 (JP) ..... 2018-213906

(51) Int. Cl.
*G03G 15/08* (2006.01)
*G03G 9/08* (2006.01)

(52) U.S. Cl.
CPC ..... *G03G 15/0812* (2013.01); *G03G 9/0821* (2013.01); *G03G 15/0808* (2013.01); *G03G 15/0818* (2013.01)

(58) Field of Classification Search
CPC ..... G03G 15/0808; G03G 15/0812; G03G 15/0818; G03G 9/0821
See application file for complete search history.

(56) References Cited

U.S. PATENT DOCUMENTS

| | | | | |
|---|---|---|---|---|
| 5,655,197 | A | 8/1997 | Okada | |
| 9,645,518 | B2 | 5/2017 | Abe | |
| 2006/0171746 | A1* | 8/2006 | Goto | G03G 15/0812 399/284 |
| 2015/0072287 | A1 | 3/2015 | Amemori | |
| 2018/0329327 | A1* | 11/2018 | Yamawaki | G03G 9/08711 |

(Continued)

FOREIGN PATENT DOCUMENTS

| | | | |
|---|---|---|---|
| EP | 2818937 | A1 | 12/2014 |
| JP | 2000122416 | A | 4/2000 |

(Continued)

OTHER PUBLICATIONS

Extended European Search Report issued in European Appln. No. 19208481.2 dated Apr. 15, 2020.

*Primary Examiner* — Ryan D Walsh
(74) *Attorney, Agent, or Firm* — Rossi, Kimms & McDowell LLP

(57) ABSTRACT

A developer borne on a developer bearing member includes a toner, the toner has a Martens hardness of at least 200 MPa and not more than 1100 MPa when measured under a condition of a maximum load of $2.0\times10^{-4}$ N, and where a contact pressure of a regulating member that regulates the developer borne on the developer bearing member against the surface of the developer bearing member is denoted by N (gf/mm) and a contact pressure of a supplying member that supplies the developer to the developer bearing member against the surface of the developer bearing member is denoted by D (gf/mm), the following expressions are satisfied: $D+2\times N-6\geq0$, $1.5\leq N\leq4.5$, and $2.0\leq D\leq4.5$.

14 Claims, 8 Drawing Sheets

(56) References Cited

U.S. PATENT DOCUMENTS

| | | | | |
|---|---|---|---|---|
| 2019/0235406 | A1* | 8/2019 | Yamawaki | G03G 9/09328 |
| 2020/0124998 | A1* | 4/2020 | Kototani | G03G 9/08782 |
| 2020/0150552 | A1* | 5/2020 | Shindo | G03G 15/1685 |
| 2020/0150553 | A1* | 5/2020 | Agata | G03G 9/08773 |
| 2020/0150555 | A1* | 5/2020 | Ikada | G03G 15/065 |
| 2020/0150557 | A1* | 5/2020 | Kihara | G03G 15/0808 |
| 2020/0150558 | A1* | 5/2020 | Oka | G03G 15/0812 |
| 2020/0150578 | A1* | 5/2020 | Yamauchi | G03G 5/06 |

FOREIGN PATENT DOCUMENTS

| | | | | |
|---|---|---|---|---|
| JP | 2005121795 | A | * | 5/2005 |
| JP | 2006301433 | A | | 11/2006 |
| JP | 2009156902 | A | | 7/2009 |
| JP | 2010032596 | A | | 2/2010 |
| JP | 2016027399 | A | | 2/2016 |

* cited by examiner

DEVELOPING DEVICE, PROCESS CARTRIDGE AND IMAGE FORMING APPARATUS

BACKGROUND OF THE INVENTION

Field of the Invention

The present invention relates to an image forming apparatus such as a copying machine, a printer, and a facsimile machine using an electrophotographic method, and more particularly to a developing device and a process cartridge that are adapted to the image forming apparatus.

Description of the Related Art

In an image forming apparatus such as a copying machine, a printer, or a facsimile machine that forms an image on a recording material using an electrophotographic image forming method (electrophotographic process), an electrostatic image is formed on an electrophotographic photosensitive member as an image bearing member in the image forming step, and the electrostatic image is developed using a developer. The developing device responsible for a developing step in the image forming step may be configured to be detachably attachable to the apparatus main body of the image forming apparatus as an independent unit or as a part of a process cartridge. The developing device includes a frame that is called a developing container or the like and accommodates a toner as a developer, and a developing roller that is rotatably disposed in the opening of the frame and serves as a developer bearing member that bears and conveys the toner from the inside of the frame body to the outside by rotating. The developing device further includes a toner supply roller as a supplying member that supplies the toner to the developing roller, and a developing blade as a regulation member that contacts the developing roller surface to regulate the amount of the toner borne by the developing roller and passing through the opening.

A method of forming an image using an electrophotographic process is currently used in various fields, and improvement in performance such as a higher speed and a higher image quality is demanded. In order to achieve both a higher speed and a higher image quality, it is necessary to increase the charge quantity of the toner and maintain the charge quantity of the toner throughout the life thereof.

Here, since the main charging means of the toner is based on friction, where the friction resistance of the toner is improved, the shear (friction opportunity and frictional force) with the charging member can be increased, leading to an increase in the charge quantity of the toner.

Here, Japanese Patent Application Publication No. 2016-027399 discloses a toner having a surface layer including an organosilicon polymer as a toner excellent in development durability and storage stability.

SUMMARY OF THE INVENTION

However, it has been found that even with the toner having excellent development durability as described above, the toner may not be durable under certain process conditions.

An object of the present invention is to suppress the occurrence of density unevenness due to potential unevenness by maintaining high charging performance of the developer over a long period of time while increasing the shear applied to the toner.

In order to achieve the above object, the developing device of the present invention comprises:

a developer bearing member that bears a developer on a surface thereof;

a supplying member that contacts the surface of the developer bearing member and supplies the developer to the surface of the developer bearing member; and a regulating member that contacts the surface of the developer bearing member and regulates the developer borne on the surface of the developer bearing member, wherein the developer includes a toner;

the toner has a Martens hardness of at least 200 MPa and not more than 1100 MPa when measured under a condition of a maximum load of $2.0\times10^{-4}$ N; and wherein a contact pressure of the regulating member against the surface of the developer bearing member is denoted by N (gf/mm) and a contact pressure of the supplying member against the surface of the developer bearing member is denoted by D (gf/mm), the following expressions are satisfied:

$$D+2\times N-6\geq 0,$$

$$1.5\leq N\leq 4.5, \text{ and}$$

$$2.0\leq D\leq 4.5.$$

In order to achieve the above object, the process cartridge of the present invention comprises:

the developing device of the present invention; and an image bearing member for bearing an electrostatic latent image to be developed by the developing device, wherein the process cartridge is capable of being detachably attached to an image forming apparatus.

In order to achieve the above object, the image forming apparatus of the present invention comprises:

the developing device of the present invention; and an image bearing member for bearing an electrostatic latent image to be developed by the developing device.

According to the present invention, high charging performance of the developer can be maintained over a long period of time, and the density change due to the potential fluctuation is reduced, so that the occurrence of density unevenness due to potential unevenness can be suppressed.

Further features of the present invention will become apparent from the following description of exemplary embodiments with reference to the attached drawings.

DESCRIPTION OF THE EMBODIMENTS

Figure 1:
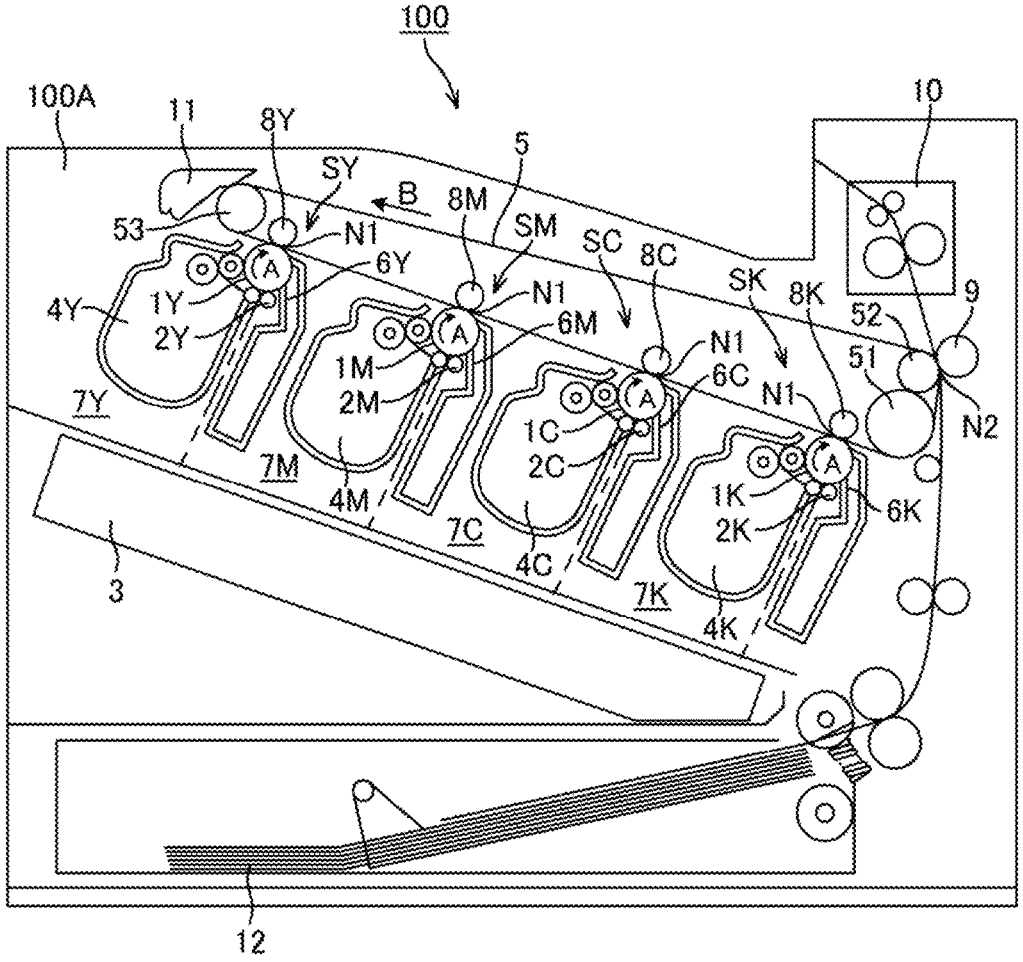
FIG. 1 is a schematic sectional view of an image forming apparatus according to an embodiment.

In the present invention, the description of "at least XX and not more than YY" or "XX to YY" representing a numerical range means a numerical range including a lower limit and an upper limit as end points unless otherwise specified.

Surface Layer Including Organosilicon Polymer

When the toner particle has a surface layer including an organosilicon polymer, the preferred structure is represented by the formula (1).

$$R—SiO_{3/2} \qquad \text{Formula (1)}$$

(R represents a hydrocarbon group having at least 1 and not more than 6 carbon atoms.)

In the organosilicon polymer having the structure of the formula (1), one of the four valences of the Si atom is bonded to R, and the remaining three are bonded to O atoms. The O atoms constitute a state in which two valences are both bonded to Si, that is, a siloxane bond (Si—O—Si). Considering Si atoms and O atoms of the organosilicon polymer, since there are three O atoms for two Si atoms, the representation is by $—SiO_{3/2}$. It is conceivable that the $—SiO_{3/2}$ structure of the organosilicon polymer has properties similar to silica ($SiO_2$) composed of a large number of siloxane bonds. Therefore, it is conceivable that the Martens hardness can be increased because of the structure which is closer to the inorganic substance as compared to the toner in which the surface layer is formed by the conventional organic resin.

In the structure represented by the formula (1), R is preferably a hydrocarbon group having at least 1 and not more than 6 carbon atoms. In such a case, the charge quantity is likely to be stable. In particular, an aliphatic hydrocarbon group having at least 1 and not more than 5 carbon atoms, or a phenyl group which is excellent in environmental stability is preferable.

In addition, it is more preferable that R be a hydrocarbon group having at least 1 and not more than 3 carbon atoms for further improving the charging performance. When the charging performance is good, the transfer property is good and the amount of residual toner is small, so that the contamination of the drum, the charging member and the transfer member is reduced.

Preferred examples of the hydrocarbon group having at least 1 and not more than 3 carbon atoms include a methyl group, an ethyl group, a propyl group, and a vinyl group. From the viewpoints of environmental stability and storage stability, R is more preferably a methyl group.

As a production example of the organosilicon polymer, a sol-gel method is preferable. The sol-gel method is a method in which a liquid raw material is used as a starting material for hydrolysis and condensation polymerization, and gelation is performed through a sol state. This method is used for synthesizing glass, ceramics, organic-inorganic hybrids, and nanocomposites. By using this production method, functional materials having various shapes such as surface layers, fibers, bulk bodies, and fine particles can be produced from a liquid phase at a low temperature.

Specifically, the organosilicon polymer present in the surface layer of the toner particle is preferably produced by hydrolysis and polycondensation of a silicon compound typified by an alkoxysilane.

By providing the toner particle with a surface layer including this organosilicon polymer, environmental stability is improved, the toner performance is less likely to deteriorate during long-term use, and a toner having excellent storage stability can be obtained.

Furthermore, since the sol-gel method starts with a liquid and forms a material by gelling the liquid, various fine structures and shapes can be created. In particular, where a toner particle is produced in an aqueous medium, precipitation on the surface of the toner particle is facilitated due to the hydrophilicity created by a hydrophilic group such as a silanol group of the organosilicon compound. The fine structure and shape can be adjusted by the reaction temperature, reaction time, reaction solvent, pH, type and amount of the organometallic compound, and the like.

The organosilicon polymer of the surface layer of the toner particle is preferably a polycondensation product of an organosilicon compound having a structure represented by a following formula (Z).

[C1]

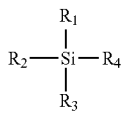

(Z)

(In the formula (Z), $R_1$ represents a hydrocarbon group having at least 1 and not more than 6 carbon atoms, and $R_2$, $R_3$, and $R_4$ each independently represent a halogen atom, a hydroxy group, an acetoxy group, or an alkoxy group.)

The hydrophobicity can be improved by the hydrocarbon group (preferably an alkyl group) of $R_1$, and a toner particle having excellent environmental stability can be obtained. Further, an aryl group, which is an aromatic hydrocarbon group, for example, a phenyl group, can also be used as the hydrocarbon group. Since charge quantity fluctuation in various environments tends to increase when the hydrophobicity of $R_1$ is large, in view of environmental stability, $R_1$ is preferably a hydrocarbon group having at least 1 and not more than 3 carbon atoms, and more preferably a methyl group.

$R_2$, $R_3$, and $R_4$ are each independently a halogen atom, a hydroxy group, an acetoxy group, or an alkoxy group (hereinafter also referred to as a reactive group). These reactive groups are hydrolyzed, addition-polymerized and condensation-polymerized to form a crosslinked structure, and a toner having excellent resistance to member contamination and development durability can be obtained. The hydrolyzation ability is moderate at room temperature, and from the viewpoint of precipitation on the surface of toner particle and coverage, an alkoxy group having at least 1 and not more than 3 carbon atoms is preferable, and a methoxy group or an ethoxy group is more preferable. The hydrolysis, addition polymerization and condensation polymerization of $R_2$, $R_3$, and $R_4$ can be controlled by the reaction temperature, reaction time, reaction solvent and pH.

In order to obtain the organosilicon polymer used in the present embodiment, organosilicon compounds having three reactive groups ($R_2$, $R_3$, and $R_4$) in one molecule excluding $R_1$ in the formula (Z) shown above (hereinafter, referred to as trifunctional silane) may be used alone or in combination of a plurality thereof.

Further, the amount of the organosilicon polymer in the toner particle is preferably at least 0.5% by mass and not more than 10.5% by mass.

Where the amount of the organosilicon polymer is 0.5% by mass or more, the surface free energy of the surface layer can be further reduced, the flowability is improved, and the occurrence of member contamination or fogging can be suppressed. Where the amount is 10.5% by mass or less, it is possible to make it difficult for charge-up to occur. The amount of the organosilicon polymer is controlled by the type and amount of the organosilicon compound used for forming the organosilicon polymer, a method for producing the toner particles at the time of forming the organosilicon polymer, the reaction temperature, reaction time, reaction solvent and pH.

The surface layer including the organosilicon polymer and the toner core particle are preferably in contact with each other without any gap. As a result, the occurrence of bleeding of the resin component, release agent and the like located on the inner side of the toner particle with respect to the surface layer can be suppressed, and a toner having excellent storage stability, environmental stability, and development durability can be obtained. In addition to the above organosilicon polymer, the surface layer may include a resin such as a styrene-acrylic copolymer resin, a polyester resin, an urethane resin, various additives, and the like.

The toner particle includes a binder resin. The binder resin is not particularly limited, and conventionally known resins can be used. Vinyl resin, polyester resins and the like are preferable.

Method for Producing Toner Particles

As a method for producing toner particles, known means can be used, and a kneading and pulverizing method or a wet production method can be used. From the viewpoint of uniform particle diameter and shape controllability, a wet production method can be preferably used. Furthermore, examples of the wet production method include a suspension polymerization method, a dissolution suspension method, an emulsion polymerization aggregation method, and an emulsion aggregation method.

Here, the suspension polymerization method will be described. In the suspension polymerization method, first, a polymerizable monomer for producing a binder resin, a colorant, and, if necessary, other additives are uniformly dissolved or dispersed using a disperser such as a ball mill, an ultrasonic disperser or the like to prepare a polymerizable monomer composition (step of preparing a polymerizable monomer composition). At this time, a polyfunctional monomer, a chain transfer agent, a wax as a release agent, a charge control agent, a plasticizer, and the like can be added as necessary.

Next, the polymerizable monomer composition is put into an aqueous medium prepared in advance, and droplets made of the polymerizable monomer composition are formed into toner particles of desired size by using a stirrer or a disperser having a high shearing force (granulation step).

It is preferable that the aqueous medium in the granulation step include a dispersion stabilizer in order to control the particle diameter of the toner particles, sharpen the particle size distribution, and suppress coalescence of the toner particles in the production process. Dispersion stabilizers are generally roughly classified into polymers that develop a repulsive force due to steric hindrance and poorly water-soluble inorganic compounds that achieve dispersion stabilization with an electrostatic repulsive force. The fine particles of the poorly water-soluble inorganic compound are preferably used because they are dissolved by an acid or an alkali and can be easily dissolved and removed by washing with an acid or an alkali after polymerization.

After the granulation step or while performing the granulation step, the temperature is preferably set to at least 50° C. and not more than 90° C. to polymerize the polymerizable monomer contained in the polymerizable monomer composition, and toner particle-dispersed solution obtained (polymerization step).

In the polymerization step, it is preferable to perform a stirring operation so that the temperature distribution in the container is uniform. Where a polymerization initiator is added, the addition can be performed at arbitrary timing and for a required time. In addition, the temperature may be raised in the latter half of the polymerization reaction for the purpose of obtaining a desired molecular weight distribution. Furthermore, in order to remove the unreacted polymerizable monomer and by-products from the system, part of the aqueous medium may be removed by distillation in the latter half of the reaction or after completion of the reaction. The distillation operation can be performed under normal or reduced pressure.

From the viewpoint of obtaining a high-definition and high-resolution image, the toner preferably has a weight average particle diameter of at least 3.0 μm and not more than 10.0 μm. The weight average particle diameter of the toner can be measured by a pore electric resistance method. The measurement can be performed, for example, by using "Coulter Counter Multisizer 3" (manufactured by Beckman Coulter, Inc.). The toner particle-dispersed solution thus obtained is sent to a filtration step for solid-liquid separation of the toner particles and the aqueous medium.

The solid-liquid separation for obtaining toner particles from the obtained toner particle-dispersed solution can be carried out by a general filtration method. Thereafter, in order to remove foreign matter that could not be removed from the toner particle, it is preferable to perform resluriying or further washing with running washing water or the like. After sufficient washing, solid-liquid separation is performed again to obtain a toner cake. Thereafter, the toner cake is dried by a known drying unit, and if necessary, a particle group having a particle diameter outside the predetermined range is separated by classification to obtain toner particles. The separated particles having a particle diameter outside the predetermined range may be reused to improve the final yield.

In the case of forming a surface layer having an organosilicon polymer, when forming toner particles in an aqueous medium, the hydrolysate of the organosilicon compound can be added, as described above, to form the surface layer while performing a polymerization step or the like in an aqueous medium. The surface layer may be also formed by using the toner particle-dispersed solution after polymerization as a core particle-dispersed solution and adding the hydrolysate of the organosilicon compound. Further, in the case of not using an aqueous medium, such as in a kneading pulverization method, the surface layer can be formed by dispersing the obtained toner particles in an aqueous medium to be used as a core particle-dispersed solution, and adding the hydrolysate of the organosilicon compound as described hereinabove.

Method for Measuring Martens Hardness

Hardness is one of the mechanical properties at or near the surface of an object and represents resistance of the object to deformation and scratching when the object is about to be deformed or scratched by foreign matter. Various measurement methods and definitions are known for hardness. For example, the appropriate measurement method is used according to the size of the measurement region. When the measurement region is 10 μm or more, a Vickers method is often used, when the measurement region is 10 μm or less, a nanoindentation method is used, and when the measurement region is 1 μm or less, an AFM or the like is used. Regarding the definitions, Brinell hardness and Vickers hardness are used as indentation hardness, Martens hardness is used as scratch hardness, and Shore hardness is used as rebound hardness.

In the measurement of toner, since the general particle diameter is from 3 μm to 10 μm, the nanoindentation method is preferably used. According to the study conducted by the inventors, Martens hardness representing scratch hardness is appropriate to specify hardness for exhibiting the effect of the present invention. This is thought to be so because the scratch hardness represents the resistance of the toner to scratching by a hard substance such as a metal or an external additive in the developing machine.

With the method for measuring the Martens hardness of the toner by the nanoindentation method, the hardness can be calculated from a load-displacement curve obtained in accordance with the procedure of the indentation test stipulated by ISO14577-1 in a commercially available apparatus conforming to ISO14577-1. In the present invention, an ultra-fine indentation hardness tester "ENT-1100b" (manufactured by Elionix Inc.) was used as an apparatus conforming to the ISO standard. The measurement method is described in the "ENT1100 Operation Manual" provided with the apparatus. The specific measurement method is as follows.

The measurement environment was maintained at 30.0° C. inside a shield case with a provided temperature control device. Keeping the ambient temperature constant is effective in terms of reducing variations in measurement data due to thermal expansion and drift. The set temperature was 30.0° C., assuming a temperature in the vicinity of the developing machine where the toner was rubbed. The sample stage used was a standard sample stage provided with the apparatus. After applying the toner, weak air flow was blown so that the toner was dispersed, and the sample stage was set on the apparatus and held for 1 h or more, and then the measurement was performed.

The measurement was performed using a flat indenter (titanium indenter, tip is made of diamond) having a planar 20 μm square tip and provided with the apparatus. A flat indenter was used because where a sharp indenter is used with respect to a small-diameter and spherical object, an object to which an external additive is attached, or an object having irregularities on the surface, such as a toner, the measurement accuracy is greatly affected. The maximum load of the test was set to $2.0\times10^{-4}$ N. By setting this test load, it is possible to measure the hardness without fracturing the surface layer of the toner under the condition corresponding to the stress applied to one toner particle in the developing unit. In the present invention, since friction resistance is important, the hardness is measured while maintaining the surface layer without fracture.

The particle to be measured was selected such that the toner alone was present on the measurement screen (field size: 160 μm width, 120 μm length) of a microscope provided with the apparatus. However, in order to eliminate the displacement error as much as possible, a particle having a particle diameter (D) in the range of ±0.5 μm of the number average particle diameter (D1) ($D1-0.5\ \mu m \leq D \leq D1+0.5\ \mu m$) was selected. The particle diameter of the particles to be measured was measured by measuring the major axis and minor axis of the toner using software provided with the apparatus, and taking [(major axis+minor axis)/2] as the particle diameter D (μm). Further, the number average particle diameter was measured by using "Coulter Counter Multisizer 3 (manufactured by Beckman Coulter, Inc.)" by a method described hereinbelow.

The measurement was performed by selecting at random 100 toner particles with a particle diameter D (μm) satisfying the above conditions. The conditions inputted at the time of measurement are as follows.

Test mode: load-unloading test
Test load: 20.000 mgf (=$2.0\times10^{-4}$ N)
Number of divisions: 1000 steps
Step interval: 10 msec When the measurement is performed by selecting "Data Analysis (ISO)" from the analysis menu, the Martens hardness is analyzed and outputted after the measurement by the software provided with the apparatus. The above measurement was performed on 100 toner particles, and the arithmetic average value was defined as the Martens hardness in the present invention.

By adjusting the Martens hardness to at least 200 MPa and not more than 1100 MPa when measured under the condition of a maximum load on the toner of $2.0\times10^{-4}$ N, it was possible to reduce the deformation of the toner in the developing unit as compared with the conventional toner. As a result, the degree of freedom of process design for increasing speed and improving image quality could be increased.

In other words, the range of options such as increasing the width of the regulating blade nip, increasing the rotational speed of the developing roller, and increasing the mixing and stirring speed of the carrier is expanded. As a result, it was possible to maintain the charge quantity while suppressing development streaks due to member scraping. Therefore, the occurrence of density unevenness could be suppressed.

When the Martens hardness is lower than 200 MPa, the shear created by the developing blade as the charge imparting member could not be withstood, the toner charge quantity was reduced, and density unevenness due to potential unevenness and dropout occurred. A preferable value of the Martens hardness is 250 MPa or more, and a more preferable value is 300 MPa or more.

Meanwhile, when the Martens hardness was higher than 1100 MPa, the developing blade and the developing roller were scraped, and development streaks occurred. A preferable value of the Martens hardness is 1000 MPa or less, and a more preferable value is 900 MPa or less.

The means for adjusting the Martens hardness to at least 200 MPa and not more than 1100 MPa when measured under the condition of a maximum load of $2.0\times10^{-4}$ N is not particularly limited. However, since the hardness is significantly higher than the hardness of organic resins used in typical toners, the aforementioned hardness is difficult to achieve with means usually used to increase the hardness. For example, the required hardness is difficult to achieve by a means for designing a resin with a high glass transition temperature, a means for increasing the resin molecular weight, a means for performing thermal curing, a means for adding a filler to the surface layer, and the like.

The Martens hardness of an organic resin used for a general toner is about 50 MPa to 80 MPa when measured under the condition of a maximum toner load of $2.0\times10^{-4}$ N. Furthermore, even when the hardness is increased by the resin design or by increasing the molecular weight, the hardness is about 120 MPa or less. Further, even when a filler such as a magnetic body or a silicon compound is filled in the vicinity of the surface layer and thermally cured, the hardness is about 185 MPa at maximum, and the toner is significantly harder than a general toner.

Method for Controlling Hardness

For example, a method for forming the surface layer of the toner of a substance such as an inorganic substance having an appropriate hardness and then controlling the chemical structure or the macrostructure thereof to obtain an appropriate hardness is one of the means for adjusting to the abovementioned specific hardness range.

As a specific example, an organosilicon polymer can be mentioned as a substance having the above-mentioned specific hardness, and the hardness can be adjusted by the number of carbon atoms directly bonded to a silicon atom of the organosilicon polymer, the carbon chain length, and the like as a material selection.

It is preferable that the toner particle have a surface layer including an organosilicon polymer, and the number of carbon atoms directly bonded to a silicon atom of the organosilicon polymer be at least 1 and not more than 3 (preferably at least 1 and not more than 2, and more preferably 1), because it is easy to adjust to the specific hardness.

As means for adjusting the Martens hardness by the chemical structure, it is possible to adjust the chemical structure such as the crosslinking and the degree of polymerization of the surface layer material. As a means for adjusting the Martens hardness by the macrostructure, it is possible to adjust the surface layer unevenness and the network structure connecting the protrusions. When an organosilicon polymer is used as a surface layer, these adjustments can be made by adjusting the pH, concentration, temperature, time, and the like when pretreating the organosilicon polymer. Further, the adjustment can be also performed by the timing, form, concentration, reaction temperature, and the like when coating the organosilicon polymer on the core particle of the toner particle.

The following method is particularly preferable in the present invention. First, core particles of toner particles are produced and dispersed in an aqueous medium to obtain a core particle-dispersed solution. The dispersion is preferably performed a concentration at this time such that the solid fraction of the core particles is at least 10% by mass and not more than 40% by mass with respect to the total amount of the core particle-dispersed solution. The temperature of the core particle-dispersed solution is preferably adjusted to 35° C. or higher. The pH of the core particle dispersion is preferably adjusted to a pH at which the condensation of the organosilicon compound does not proceed easily. Since the pH at which the condensation of the organosilicon polymer does not proceed easily differs depending on the substance, the pH is preferably within ±0.5 of the pH at which the reaction is most difficult to proceed.

Meanwhile, it is preferable to use a hydrolyzed organosilicon compound. For example, the organosilicon compound is hydrolyzed in a separate container as a pretreatment. The preparation concentration for hydrolysis is preferably at least 40 parts by mass and not more than 500 parts by mass, and more preferably at least 100 parts by mass and not more than 400 parts by mass of water from which ion component has been removed, such as ion exchanged water or RO water, when the amount of the organosilicon compound is 100 parts by mass. The hydrolysis conditions are preferably a pH of 2 to 7, a temperature of 15° C. to 80° C., and a time of 30 min to 600 min.

By mixing the obtained hydrolysate and the core particle-dispersed solution and adjusting the pH to be suitable for condensation (preferably 6 to 12, or 1 to 3, more preferably 8 to 12), it is possible to form a surface layer on the core particle surface of the toner particle while causing condensation of the organosilicon compound. The condensation and surface layer formation are preferably performed at 35° C. or higher for 60 min or longer. In addition, the macrostructure of the surface can be adjusted by adjusting the holding time at 35° C. or higher before adjusting to a pH suitable for condensation, but in order to easily obtain a specific Martens hardness, an interval at least 3 min and not more than 120 min is preferable.

By the means as described above, the amount of the reaction residue can be reduced, irregularities can be formed on the surface layer, and a network structure can be formed between the projections, so that it is easy to obtain a toner having the specific Martens hardness. When a surface layer including an organosilicon polymer is used, the fixing ratio of the organosilicon polymer on the surface of the toner particle is preferably at least 90% and not more than 100%, and more preferably at least 95% and not more than 100%. A method for measuring the fixing ratio of the organosilicon polymer on the surface of the toner particle will be described hereinbelow.

Measurement of Particle Diameter of Toner (Particle)

A precision particle size distribution measuring device (trade name: Coulter Counter Multisizer 3) based on a pore electric resistance method and dedicated software (trade name: Beckman Coulter Multisizer 3, Version 3.51, manufactured by Beckman Coulter, Inc.) were used. The aperture diameter was 100 μm, the measurement was performed with 25,000 effective measurement channels, and the measurement data were analyzed and calculated. "ISOTON II" (trade name) manufactured by Beckman Coulter, Inc., which is a solution prepared by dissolving special grade sodium chloride in ion exchanged water to a concentration of about 1% by mass, was used as the electrolytic aqueous solution for measurements. The dedicated software was set up in the following manner before the measurement and analysis.

The total count number in a control mode was set to 50,000 particles on a "CHANGE STANDARD MEASUREMENT METHOD (SOM) SCREEN" of the dedicated software, the number of measurements was set to 1, and a value obtained using ("standard particles 10.0 μm", manufactured by Beckman Coulter, Inc.) was set as a Kd value. The threshold and the noise level were automatically set by pressing a measurement button of thresholdlnoise level. Further, the current was set to 1600 μA, the gain was set to 2, the electrolytic solution was set to ISOTON II (trade name), and flush of aperture tube after measurement was checked.

In the "PULSE TO PARTICLE DIAMETER CONVERSION SETTING SCREEN" of the dedicated software, the bin interval was set to a logarithmic particle diameter, the particle diameter bin was set to a 256-particle diameter bin, and a particle diameter range was set at least 2 μm and not more than 60 μm.

The specific measurement method is described hereinbelow.

(1) Approximately 200 mL of the electrolytic aqueous solution was placed in a glass 250 mL round-bottom beaker dedicated to Multisizer 3, the beaker was set in a sample stand, and stirring with a stirrer rod was carried out counterclockwise at 24 revolutions per second. Dirt and air bubbles in the aperture tube were removed by the "FLUSH OF APERTURE TUBE" function of the dedicated software.

(2) About 30 mL of the electrolytic aqueous solution was placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water was added thereto.

(3) A predetermined amount of ion exchanged water and about 2 mL of the CONTAMINON N (trade name) were added in the water tank of an ultrasonic disperser (trade name: Ultrasonic Dispersion System Tetora 150, manufactured by Nikkaki Bios Co., Ltd.) with an electrical output of 120 W in which two oscillators with an oscillation frequency of 50 kHz are built in with a phase shift of 180 degrees.

(4) The beaker of (2) hereinabove was set in the beaker fixing hole of the ultrasonic disperser, and the ultrasonic disperser was actuated. Then, the height position of the beaker was adjusted so that the resonance state of the liquid surface of the electrolytic aqueous solution in the beaker was maximized.

(5) About 10 mg of the toner (particles) was added little by little to the electrolytic aqueous solution and dispersed therein in a state in which the electrolytic aqueous solution in the beaker of (4) hereinabove was irradiated with ultrasonic waves. Then, the ultrasonic dispersion process was further continued for 60 sec. In the ultrasonic dispersion, the water temperature in the water tank was appropriately adjusted to a temperature of at least 10° C. and not more than 40° C.

(6) The electrolytic aqueous solution of (5) hereinabove in which the toner (particles) was dispersed was dropped using a pipette into the round bottom beaker of (1) hereinabove which was set in the sample stand, and the measurement concentration was adjusted to be about 5%. Then, measurement was conducted until the number of particles to be measured reached 50,000.

(7) The measurement data were analyzed with the dedicated software provided with the apparatus, and the weight average particle diameter (D4) was calculated. The "AVERAGE DIAMETER" on the analysis/volume statistical value (arithmetic mean) screen when the dedicated software was set to graph/volume % was the weight average particle diameter (D4). The "AVERAGE DIAMETER" on the analysis/number statistical value (arithmetic mean) screen when the dedicated software was set to graph/number % was the number average particle diameter (D1).

Measurement of Amount of Organosilicon Polymer in Toner Particle

The amount of the organosilicon polymer was measured using a wavelength dispersive X-ray fluorescence analyzer "Axios" (manufactured by PANalytical) and dedicated software "SuperQ ver. 4.0F" (manufactured by PANalytical) provided therewith for setting measurement conditions and analyzing measurement data. Rh was used as the anode of the X-ray tube, the measurement atmosphere was vacuum, the measurement diameter (collimator mask diameter) was 27 mm, and the measurement time was 10 sec. Further, when measuring a light element, the element was detected by a proportional counter (PC), and when measuring a heavy element, the element was detected by a scintillation counter (SC).

A pellet prepared by placing 4 g of toner particles in a dedicated aluminum ring for pressing and molding to a thickness of 2 mm and a diameter of 39 mm by pressing for 60 secs under 20 MPa with a tablet molding compressor "BRE-32" (manufactured by Maekawa Test Instruments Co., Ltd.) was used as a measurement sample.

Silica ($SiO_2$) fine powder was added to constitute 0.5 parts by mass with respect to 100 parts by mass of toner particles not containing an organosilicon polymer, and sufficient mixing was performed using a coffee mill. Similarly, the silica fine powder was mixed with the toner particles so as to constitute 5.0 parts by mass and 10.0 parts by mass, respectively, and these were used as samples for a calibration curve.

For each sample, the pellet of the sample for a calibration curve was prepared as described above using a tablet molding compressor, and a count rate (unit: cps) of Si—Kα rays observed at a diffraction angle (2θ) of 109.08° when using PET as a spectroscopic crystal was measured. At this time, the acceleration voltage and current value of the X-ray generator were set to 24 kV and 100 mA, respectively. A calibration curve in the form of a linear function was obtained by plotting the obtained X-ray count rate on the ordinate and plotting the added amount of $SiO_2$ in each sample for a calibration curve on the abscissa.

Next, the toner particles to be analyzed were pelletized as described above using the tablet molding compressor, and the count rate of the Si—Kα rays was measured. Then, the amount of the organosilicon polymer in the toner particle was determined from the above calibration curve.

Method for Measuring Adhesion Ratio of Organosilicon Polymer

A total of 160 g of sucrose (manufactured by Kishida Chemical Co., Ltd.) was added to 100 mL of ion exchanged water and dissolved while forming a hot water bath to prepare a concentrated sucrose solution. Then, 31 g of the concentrated sucrose solution and 6 mL of CONTAMINON N (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) were placed in a centrifuge tube (capacity 50 mL) to prepare a dispersion liquid. To this dispersion liquid, 1.0 g of the toner was added, and the lump of the toner was loosened with a spatula or the like.

The centrifuge tube was shaken with a shaker at 350 spin (strokes per min) for 20 min. After shaking, the solution was transferred to a glass tube for a swing rotor (capacity 50 mL), and separated by a centrifuge (H-9R manufactured by Kokusan Co., Ltd.) at 3500 rpm for 30 min. It was visually confirmed that the toner and the aqueous solution were sufficiently separated, and the toner separated in the uppermost layer was collected with a spatula or the like. The aqueous solution including the collected toner particles was filtered with a vacuum filter and then dried with a dryer for 1 h or longer. The dried product was crushed with a spatula, and the amount of silicon was measured with fluorescent X-rays. The fixing ratio (%) was calculated from the silicon amount ratio of the measurement target of the toner particles after washing and the toner particles before washing.

The measurement of fluorescent X-rays of each element conforms to JIS K 0119-1969, and is specifically as follows.

A wavelength dispersive X-ray fluorescence analyzer "Axios" (manufactured by PANalytical) and dedicated software "SuperQ ver. 4.0F" (manufactured by PANalytical) provided therewith were used as the measurement device. Rh was used as the anode of the X-ray tube, the measurement atmosphere was vacuum, the measurement diameter (collimator mask diameter) was 10 mm, and the measurement time was 10 sec. Further, when measuring a light element, the element was detected by a proportional counter (PC), and when measuring a heavy element, the element was detected by a scintillation counter (SC).

A pellet to be used as a measurement sample was prepared by placing about 1 g of washed toner particles and initial toner particles in a dedicated aluminum ring having a diameter of 10 mm for pressing, leveling the toner, and pressing with a tablet molding compressor "BRE-32" (manufactured by Maekawa Test Instruments Co., Ltd.) for 60 secs under 20 MPa to form a tablet having a thickness of about 2 mm.

The measurement was performed under the above conditions, the elements were identified based on the obtained X-ray peak positions, and the concentration thereof was calculated from the count rate (unit: cps) which is the number of X-ray photons per unit time.

As a method for quantitative determination in the toner particle, for example, for the silicon amount, silica ($SiO_2$) fine powder was added to constitute 0.5 parts by mass with respect to 100 parts by mass of the toner particles, and sufficient mixing was performed using a coffee mill. Similarly, the silica fine powder was mixed with the toner particles so as to constitute 2.0 parts by mass and 5.0 parts by mass, respectively, and resulting samples were used as samples for the calibration curve.

For each sample, the pellet of the sample for a calibration curve was prepared as described above using a tablet molding compressor, and a count rate (unit: cps) of Si—Kα rays observed at a diffraction angle (2θ) of 109.08° when using PET as a spectroscopic crystal was measured. At this time, the acceleration voltage and current value of the X-ray generator were set to 24 kV and 100 mA, respectively. A calibration curve in the form of a linear function was obtained by plotting the obtained X-ray count rate on the ordinate and plotting the added amount of $SiO_2$ in each sample for a calibration curve on the abscissa.

Next, the toner particles to be analyzed were pelletized as described above using the tablet molding compressor, and the count rate of the Si—Kα rays was measured. Then, the amount of the organosilicon polymer in the toner particle was determined from the above calibration curve. The ratio of the element amount in the toner particle after washing to the element amount in the toner particle before washing calculated by the above method was obtained and taken as the fixing ratio (%).

Method for Preparing THF-Insoluble Fraction of Toner Particles for NMR Measurement The tetrahydrofuran (THF)-insoluble fraction of toner particles was prepared in the following manner.

A total of 10.0 g of toner particles were weighed, placed into a cylindrical filter paper (No. 86R manufactured by Toyo Filter Paper K.K.) and put in a Soxhlet extractor. Extraction was carried out for 20 h using 200 mL of THF as a solvent, and the dry product obtained by vacuum drying the filtrate in the cylindrical filter paper at 40° C. for several hours was taken as the THF-insoluble fraction of the toner particles for NMR measurement.

Where the surface of the toner particle has been treated with an external additive or the like, the external additive is removed by the following method to obtain the toner particle.

A total of 160 g of sucrose (manufactured by Kishida Chemical Co., Ltd.) is added to 100 mL of ion exchanged water, and dissolved while heating with hot water to prepare a sucrose concentrated solution. A total of 31 g of the sucrose concentrated solution and 6 mL of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube (capacity 50 mL) to prepare a dispersion liquid. A total of 1.0 g of the toner is added to the dispersion liquid and the toner lump is loosened with a spatula or the like.

The centrifuge tube is shaken with a shaker at 350 spm (strokes per min) for 20 min. After shaking, the solution is transferred into a glass tube for a swing rotor (capacity 50 mL) and separated by a centrifuge (H-9R, manufactured by KOKUSAN Co., Ltd.) at 3500 rpm for 30 min. By this operation, the toner particles are separated from the detached external additive. It is visually confirmed that the toner and the aqueous solution are sufficiently separated, and the toner separated in the uppermost layer is collected with a spatula or the like. The collected toner is filtered with a vacuum filter and then dried with a dryer for 1 h or longer to obtain toner particles. This operation is performed multiple times to ensure the required amount.

Confirmation Method of Structure Shown by Formula (1)

The following method is used to confirm the structure represented by the formula (1) in the organosilicon polymer included in the toner particle.

The hydrocarbon group represented by R in the formula (1) was confirmed by $^{13}C$-NMR.

Measurement Conditions for $^{13}C$-NMR (Solid)

Apparatus: JNM-ECX500II manufactured by JEOL RESONANCE Co., Ltd.

Sample tube: 3.2 mmϕ

Sample: 150 mg of tetrahydrofuran-insoluble fraction of toner particles for NMR measurement Measurement temperature: room temperature Pulse mode: CP/MAS Measurement nuclear frequency: 123.25 MHz ($^{13}C$)

Reference substance: adamantane (external standard: 29.5 ppm)

Sample rotation speed: 20 kHz

Contact time: 2 ms

Delay time: 2 s

Integration count: 1024 times

In this method, a hydrocarbon group represented by R in the formula (1) was confirmed by the presence or absence of a signal due to a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$) or a phenyl group (Si—$C_6H_5$—) bonded to a silicon atom.

Calculation Method of Proportion of Peak Area Attributed to Structure of Formula (1) in Organosilicon Polymer Included in Toner Particle The measurement of $^{29}Si$-NMR (solid) of the THF-insoluble fraction of toner particles is performed under the following measurement conditions.

Measurement Conditions for $^{29}Si$-NMR (Solid)

Apparatus: JNM-ECX500II manufactured by JEOL RESONANCE Co., Ltd.

Sample tube: 3.2 mmϕ

Sample: 150 mg of tetrahydrofuran-insoluble fraction of toner particles for NMR measurement Measurement temperature: room temperature Pulse mode: CP/MAS Measurement nuclear frequency: 97.38 MHz ($^{29}Si$)

Reference substance: DSS (external standard: 1.534 ppm)

Sample rotation speed: 10 kHz

Contact time: 10 ms

Delay time: 2 s

Integration count: 2000 times to 8000 times

After the measurement, a plurality of silane components having different substituents and bonding groups in the tetrahydrofuran-insoluble fraction of the toner particles are separated into peaks by curve fitting into the following structure X1, structure X2, structure X3, and structure X4.

Structure X1:$(Ri)(Rj)(Rk)SiO_{1/2}$ (2)

Structure X2:$(Rg)(Rh)Si(O_{1/2})_2$ (3)

Structure X3:$RmSi(O_{1/2})_3$ (4)

Structure X4:$Si(O_{1/2})_4$ (5)

[C2]

Structure X1:

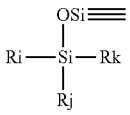

(2)

Structure X2:

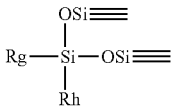

(3)

Structure X3:

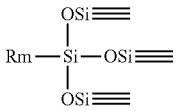

(4)

Structure X4:

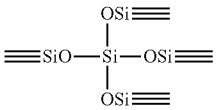

(5)

(Ri, Rj, Rk, Rg, Rh, and Rm in the formulas (2), (3) and (4), represent an organic group such as a hydrocarbon group having 1 to 6 carbon atoms, a halogen atom, a hydroxy group, an acetoxy group or an alkoxy group bonded to silicon.)

In addition, when it is necessary to confirm the structure represented by the above formula (1) in greater detail, the structure may be identified by the measurement result of $^{1}$H-NMR together with the measurement result of $^{13}$C-NMR and $^{29}$Si-NMR.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Overall Schematic Configuration of Image Forming Apparatus

An overall configuration of an electrophotographic image forming apparatus (hereinafter referred to as an image forming apparatus) according to an embodiment of the present invention will be described with reference to FIG. 1. FIG. 1 is a schematic cross-sectional view of an image forming apparatus 100 of the present embodiment. Examples of the image forming apparatus to which the present invention can be applied include a copying machine, a printer, a facsimile, machine and the like using an electrophotographic system. Here, a case where the present invention is applied to a laser printer will be described. The image forming apparatus 100 of the present embodiment is a full-color laser printer that employs an inline system and an intermediate transfer system. The image forming apparatus 100 can form a full-color image on a recording material (for example, recording paper, plastic sheet, cloth, and the like) according to the image information. The image information is inputted to an image forming apparatus main body 100A from an image reading device connected to the image forming apparatus main body 100A or from a host device such as a personal computer communicably connected to the image forming apparatus main body 100A.

The image forming apparatus 100 includes, as a plurality of image forming units, first, second, third and fourth image forming units SY, SM, SC, and SK for forming images of yellow (Y), magenta (M), cyan (C), and black (K) colors, respectively. In the present embodiment, the first to fourth image forming units SY, SM, SC, and SK are arranged in a line in a direction that intersects the vertical direction. In the present embodiment, the configurations and operations of the first to fourth image forming units SY, SM, SC, and SK are substantially the same except that the colors of images to be formed are different. Therefore, in the following general explanation, the symbols Y, M, C, and K given to the reference numerals to indicate that they are elements provided for a certain color are omitted, unless a specific unit needs to be identified.

In the present embodiment, the image forming apparatus 100 includes four drum-type electrophotographic photosensitive members, that is, the photosensitive drums 1, arranged in parallel in a direction intersecting the vertical direction as a plurality of image bearing members. The photosensitive drum 1 is rotationally driven in a direction indicated by an arrow A (clockwise) by a driving unit (drive source) (not shown). A charging roller 2 as a charging portion for uniformly charging the surface of the photosensitive drum 1, and a scanner unit (exposure device) 3 as an exposure portion for forming an electrostatic image (electrostatic latent image) on the photosensitive drum 1 by laser irradiation based on image information are disposed around the photosensitive drum 1. A developing unit (developing device) 4 as a developing portion for developing the electrostatic image as a toner image (developer image), and a cleaning member 6 as a cleaning portion for removing the untransferred toner remaining on the surface of the photosensitive drum 1 are also disposed around the photosensitive drum 1. Further, an intermediate transfer belt 5 as an intermediate transfer member for transferring the toner image on the photosensitive drum 1 to the recording material 12 is disposed above the photosensitive drum 1 so as to face the four photosensitive drums 1.

In the present embodiment, the developing unit 4 as a developing device uses the toner of a non-magnetic one-component developer as a developer. Further, in the present embodiment, the developing unit 4 performs reverse development by bringing a developing roller as a developer bearing member into contact with the photosensitive drum 1. That is, in the present embodiment, the developing unit 4 develops the electrostatic image by causing the toner charged to the same polarity (negative polarity in the present embodiment) as the charging polarity of the photosensitive drum 1 to adhere to a portion (image portion, exposed portion) in which the charge has been attenuated by exposure on the photosensitive drum 1.

In the present embodiment, the photosensitive drum 1 and the charging roller 2, the developing unit 4 and the cleaning member 6 as process unit acting on the photosensitive drum 1 are integrated, that is, integrated into a cartridge to form a process cartridge 7. The process cartridge 7 can be attached to and detached from the image forming apparatus 100 by a mounting portion such as a mounting guide and a positioning member provided at the image forming apparatus main body 100A. In the present embodiment, the process cartridges 7 for each color all have the same shape, and toners of yellow (Y), magenta (M), cyan (C), and black (K) colors are accommodated in process cartridges 7 of respective colors.

The intermediate transfer belt 5 formed of an endless belt as an intermediate transfer member contacts all the photosensitive drums 1 and circulates (rotates) in the direction of arrow B (counterclockwise) in the figure. The intermediate transfer belt 5 is wound around a driving roller 51, a secondary transfer counter roller 52, and a driven roller 53 as a plurality of support members. On the inner peripheral surface side of the intermediate transfer belt 5, four primary transfer rollers 8 serving as primary transfer units are arranged in parallel so as to face the respective photosensitive drums 1. The primary transfer roller 8 presses the intermediate transfer belt 5 toward the photosensitive drum 1 to form a primary transfer portion N1 where the intermediate transfer belt 5 and the photosensitive drum 1 are in contact with each other. A bias having a polarity opposite to the normal charging polarity of the toner is applied to the primary transfer roller 8 from a primary transfer bias power source (high-voltage power source) as a primary transfer bias applying unit (not shown). As a result, the toner image on the photosensitive drum 1 is transferred (primary transfer) onto the intermediate transfer belt 5.

Further, a secondary transfer roller 9 as a secondary transfer unit is disposed at a position facing the secondary transfer counter roller 52 on the outer peripheral surface side of the intermediate transfer belt 5. The secondary transfer roller 9 is pressed against the secondary transfer counter roller 52, with the intermediate transfer belt 5 being interposed therebetween, to form a secondary transfer portion N2 where the intermediate transfer belt 5 and the secondary transfer roller 9 come into contact. A bias having a polarity opposite to the normal charging polarity of the toner is applied to the secondary transfer roller 9 from a secondary transfer bias power source (high-voltage power source) as a secondary transfer bias applying unit (not shown). As a result, the toner image on the intermediate transfer belt 5 is transferred (secondary transfer) to the recording material 12.

More specifically, at the time of image formation, the surface of the photosensitive drum 1 is initially uniformly charged by the charging roller 2. Next, the surface of the charged photosensitive drum 1 is scanned and exposed by laser light corresponding to the image information generated from the scanner unit 3, and an electrostatic image corresponding to the image information is formed on the photosensitive drum 1. Next, the electrostatic image formed on the photosensitive drum 1 is developed as a toner image by the developing unit 4. The toner image formed on the photosensitive drum 1 is transferred (primary transfer) onto the intermediate transfer belt 5 by the action of the primary transfer roller 8.

For example, when a full-color image is formed, the above-described processes up to the primary transfer are sequentially performed in the first to fourth image forming units SY, SM, SC, and SK, and toner images of each color are primarily transferred in superposition with each other onto the intermediate transfer belt 5. Thereafter, a recording material 12 is conveyed to the secondary transfer portion N2 in synchronization with the movement of the intermediate transfer belt 5. The four color toner images on the intermediate transfer belt 5 are secondarily transferred onto the recording material 12 collectively by the action of the secondary transfer roller 9 that is in contact with the intermediate transfer belt 5 with the recording material 12 being interposed therebetween. The recording material 12 onto which the toner image has been transferred is conveyed to the fixing device 10 as a fixing unit. The toner image is fixed on the recording material 12 by applying heat and pressure to the recording material 12 in the fixing device 10. The recording material 12 on which the toner image is fixed is conveyed further downstream from the fixing device 10 and discharged outside the apparatus.

The primary untransferred toner remaining on the photosensitive drum 1 after the primary transfer process is removed and collected by the cleaning member 6. The secondary untransferred toner remaining on the intermediate transfer belt 5 after the secondary transfer process is cleaned by the intermediate transfer belt cleaning device 11. The image forming apparatus 100 can form a single-color or multi-color image using only one desired image forming unit or using only some (not all) image forming units.

Schematic Configuration of Process Cartridge

Figure 2:
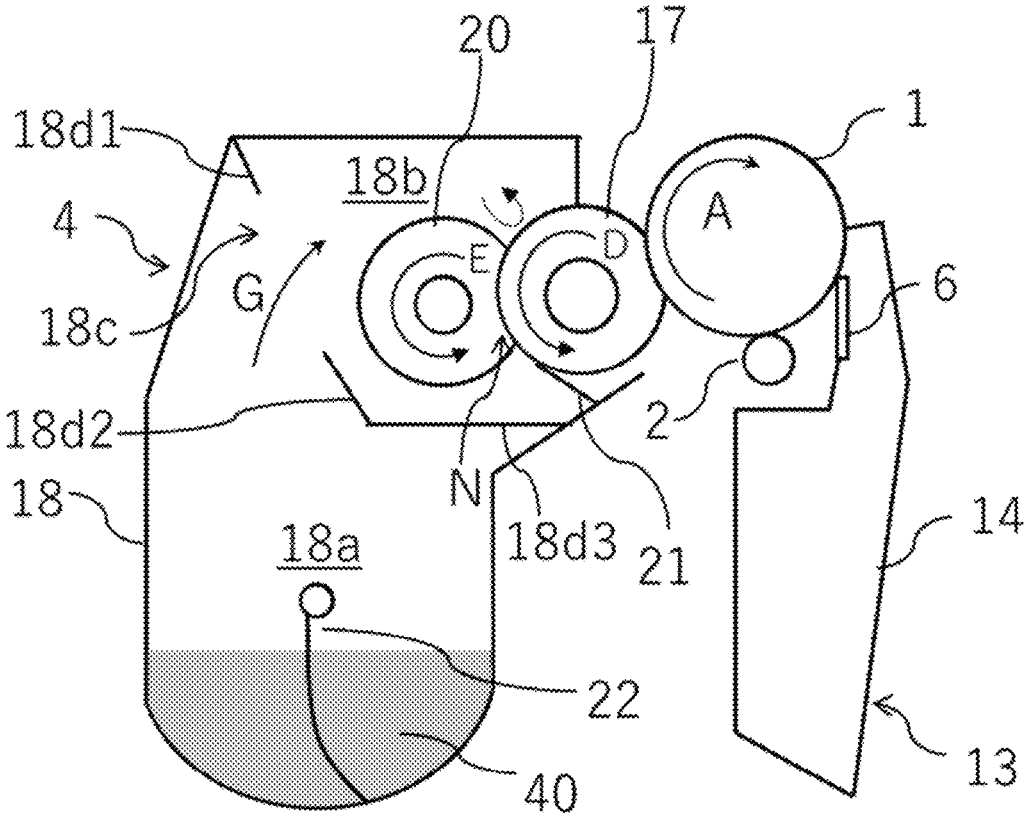
FIG. 2 is a schematic sectional view of a process cartridge according to the embodiment.

The overall configuration of the process cartridge 7 mounted on the image forming apparatus 100 of the present embodiment will be described with reference to FIG. 2. In the present embodiment, the configuration and operation of the process cartridge 7 for each color are substantially the same except for the type (color) of the accommodated toner. FIG. 2 is a schematic cross-sectional view (main cross-sectional view) of the process cartridge 7 of the present embodiment viewed along the longitudinal direction (rotational axis direction) of the photosensitive drum 1. The posture of the process cartridge 7 in FIG. 2 is that of the process cartridge mounted on the image forming apparatus main body, and where the positional relationship and direction of each member of the process cartridge are described hereinbelow, the positional relationship and direction in this posture are shown. That is, the up-down direction in FIG. 2 corresponds to the vertical direction, and the left-right direction corresponds to the horizontal direction. The setting of the arrangement configuration is based on the assumption that the image forming apparatus is installed on a horizontal plane as a normal installation state.

The process cartridge 7 is configured by integrating a photosensitive unit 13 having a photosensitive drum 1 and the like and a developing unit 4 having a developing roller 17 and the like. The photosensitive unit 13 has a cleaning frame 14 as a frame that supports various elements in the photosensitive unit 13. The photosensitive drum 1 is rotatably attached to the cleaning frame 14 by a bearing (not shown). The photosensitive drum 1 is rotationally driven in the direction of the arrow A (clockwise) in accordance with the image forming operation by transmitting the driving force of a driving motor (not shown) as a driving portion (driving source) to the photosensitive unit 13. In the present embodiment, the photosensitive drum 1 that is the most important component in the image forming process is an organic photosensitive drum 1 in which an outer surface of an aluminum cylinder is coated with an undercoat layer which is a functional film, a carrier generation layer, and a carrier transfer layer in this order.

Further, the cleaning member 6 and the charging roller 2 are disposed in the photosensitive unit 13 so as to be in contact with the peripheral surface of the photosensitive drum 1. The untransferred toner removed from the surface of the photosensitive drum 1 by the cleaning member 6 falls down and is accommodated in the cleaning frame 14. The charging roller 2 as a charging portion is driven to rotate by bringing the roller portion made of conductive rubber into pressure contact with the photosensitive drum 1. Here, as a charging step, a predetermined DC voltage, with respect to the photosensitive drum 1, is applied to the core of the charging roller 2, whereby a uniform dark portion potential (Vd) is formed on the surface of the photosensitive drum 1. A spot pattern of the laser beam emitted correspondingly to the image data by the laser beam from the scanner unit 3 described above exposes the photosensitive drum 1, and on the exposed portion, the charge on the surface is eliminated by the carrier from the carrier generation layer, and the potential drops. As a result, an electrostatic latent image with a predetermined light portion potential (V1) is formed at an exposed portion, and an electrostatic latent image with a predetermined dark portion potential (Vd) is formed at an unexposed portion on the photosensitive drum 1. In the present embodiment, Vd=−500 V and V1=−100 V.

Developing Unit

The developing unit 4 includes a developing roller 17, a developing blade 21, a toner supply roller 20, and a stirring and conveying member 22. The developing roller 17 serving as a developer bearing member bears the toner 40. The developing blade 21 serving as a regulating member regulates the toner 40 (layer thickness) borne on the developing roller 17. The toner supply roller 20 serving as a developer supplying member supplies the toner 40 to the developing roller 17. The stirring and conveying member 22 serving as a conveying member conveys the toner 40 to the toner supply roller 20. The developing unit 4 includes a developing container 18 as a frame on which the developing roller 17, the toner supply roller 20, and the stirring and conveying member 22 are rotatably assembled. The developing container 18 has a toner accommodating chamber 18*a* in which the stirring and conveying member 22 is disposed, a developing chamber 18*b* in which the developing roller 17 and the toner supply roller 20 are disposed, and a communication port 18*c* that communicates the toner accommodating chamber 18*a* and the developing chamber 18*b* with each other so as to enable the movement of the toner 40. The communication port 18*c* is provided in a partition wall portion 18*d* (18*d*1 to 18*d*3) that partitions the toner accommodating chamber 18*a* and the developing chamber 18*b*.

The partition wall portion 18*d* divides the internal space of the developing frame 18 into the toner accommodating chamber 18*a* and the developing chamber 18*b*. The partition wall portion 18*d* has a first wall portion 18*d*1 that partitions the internal space of the developing frame 18 above the communication port 18*c*, a second wall portion 18*d*2 that partitions the space below the communication port 18*c*, and a third wall portion 18*d*3 that is connected to the second wall portion 18*d*2 and partitions the space below the toner supply roller 20 and the developing roller 17. The first wall portion 18*d*1 and the second wall portion 18*d*2 extend in a direction inclined with respect to the vertical direction so that the opening direction of the communication port 18*c* from the toner accommodating chamber 18*a* toward the developing chamber 18*b* faces upward with respect to the horizontal direction. The communication port 18*c* opens in a region in the partition wall portion 18*d* on the side of the toner supply roller 20 opposite that of the developing roller 17 so as to face a space above the toner supply roller 20 in the developing chamber 18*b*. As a result, the internal space of the developing chamber 18*b* is configured so as to expand horizontally in the upward direction and so that the communication port 18*c* easily accepts the toner 40 that is lifted by the stirring and conveying member 22 from the lower side of the toner accommodating chamber 18*a* upward. The third wall portion 18*d*3 extends in a substantially horizontal direction from the lower end of the second wall portion 18*d*2 below the toner supply roller 20 and the developing roller 17. The third wall portion 18*d*3 and the second wall portion 18*d*2 form a configuration (a storage tank for the toner 40) such that receives the toner 40 spilled from the toner supply roller 20 and the developing roller 17 out of the toner 40 that has passed through the communication port 18*c*. The configuration composed of the second wall portion 18*d*2 and the third wall portion 18*d*3 is formed to extend from one side surface of the developing frame 18 to the other side surface in the longitudinal direction (the direction along the rotational axis of the developing roller 17 or the toner supply roller 20).

Here, the internal space of the developing chamber 18*b* is considered as being divided into a first space, a second space, and a third space. In FIGS. 8A and 8B, the first space is denoted by S1, the second space by S2, and the third space by S3.

The first space refers to a space above the nip portion N in the developing chamber 18*b*. More specifically, the first space is a spatial region above the nip portion N in the internal space of the developing chamber 18*b* where the peripheral surfaces of the toner supply roller 20 and the developing roller 17 and the inner wall portion surface of the developing chamber 18*b* face each other. The first space is surrounded by a region of the peripheral surfaces of the toner supply roller 20 and the developing roller 17 above the nip portion N, the inner wall portion surface of the developing chamber 18*b* facing these, and both longitudinal side surfaces of the developing chamber 18*b*.

The second space refers to a space provided in the developing chamber 18*b* so as to expand in the downstream direction of the rotation of the toner supply roller 20, with the narrow portion below the toner supply roller 20 serving as a boundary.

Here, the narrow portion refers to a portion where the gap between the third wall portion 18*d*3 of the wall portion 18*d* defining the internal space of the developing chamber 18*b* and the peripheral surface of the toner supply roller 20 is the narrowest in the region where the third wall portion and the peripheral surface of the toner supply roller face each other.

More specifically, the second space is a spatial region where the gap between the peripheral surface of the toner supply roller 20 and the third wall portion 18*d*3 gradually expands toward the downstream side in the rotation direction of the toner supply roller 20, with a narrow portion in the space between the toner supply roller 20 and the third wall portion 18*d*3 serving as a boundary. The second space is surrounded by the third wall portion 18*d*3, regions of the peripheral surfaces of the toner supply roller 20 and the developing roller 17 facing the third wall portion, the developing blade 21, and both longitudinal side surfaces of the developing chamber 18*b* on the downstream side in the rotation direction of the toner supply roller 20.

The third space refers to a space provided in the developing chamber 18*b* so that the space expands in the upstream direction of rotation of the toner supply roller 20, with the narrow portion serving as a boundary. More specifically, the third space is a spatial region where the gap between the peripheral surface of the toner supply roller 20 and the third wall portion 18*d*3 gradually increases toward the upstream side in the rotation direction, with a narrow portion serving as a boundary, in the space between the peripheral surface of the toner supply roller 20 and the third wall portion 18*d*3. The third space is surrounded by the second wall portion 18*d*2 and the third wall portion 18*d*3, a region of the peripheral surface of the toner supply roller 20 facing the two wall portions, and both longitudinal end surfaces of the developing chamber 18*b* upstream of the narrow portion in the rotation direction of the toner supply roller 20.

In the present embodiment, the second space is configured to be wider than the third space in the cross sections shown in FIGS. 2, 8A and 8B, etc.

The toner 40 lifted by the stirring and conveying member 22 is supplied above (first space) the nip portion N over the toner supply roller 20 because the upper end (the boundary with the lower end of the first wall portion 18*d*1) of the communication port 18*c* is disposed higher than the upper end of the toner supply roller 20. The toner 40 supplied above the nip portion N (first space) is sucked into the toner supply roller 20 (in the bubble cavities of the foam layer) by the deformation of the toner supply roller 20, moves counterclockwise (in the drawing) as the toner supply roller 20 rotates, and reaches the lower end of the nip portion N. Further, a part of the toner 40 lifted by the stirring and conveying member 22 and supplied to the surface of the toner supply roller 20 is partially returned to the toner accommodating chamber 18*a* by the rotation of the toner supply roller 20 in the arrow E direction. The remaining toner 40 is conveyed toward a region below the toner supply roller 20 (third space→second space).

When reaching the lower end of the nip portion N, the toner 40 is discharged from the inside of the toner supply roller 20 (the inside of the bubble cavities of the foam layer) by the deformation of the toner supply roller 20 and is supplied to the developing roller 17 while rubbing against the nip portion N. The toner 40 adhering to the developing roller 17 is regulated by the developing blade 21 and charged, and a uniform toner coat is formed on the developing roller 17 by the toner 40 that has passed through the regulating portion. Further, the toner 40 that remains without being developed in the developing portion is also scraped strongly by the surfaces of the toner supply roller 20 and the developing roller 17 rotating in opposite directions at the nip portion N. The toner 40 regulated by the developing blade 21 and detached from the developing roller 17 falls below (second space) the developing blade 21. Further, the toner 40 that has been discharged from the inside of the toner supply roller 20 and has not adhered to the developing roller 17 is discharged below (second space) the nip portion N.

When the above operation is repeated, the toner 40 is accumulated in the second space to form a compacted state of the toner 40. When the compacted state is formed, the toner 40 is supplied from the compacted portion to the surface of the toner supply roller 20 or inside thereof. Further, due to the formation of the compacted state, the toner 40 passes through the narrow portion and moves from the second space (compaction space) to the third space. Due to the pressure of the flow of the toner 40, a part of the toner 40 gets over the upper end of the second wall portion 18*d*2 below the communication port 18*c* and is returned to the toner accommodating chamber 18*a*.

Figure 8:
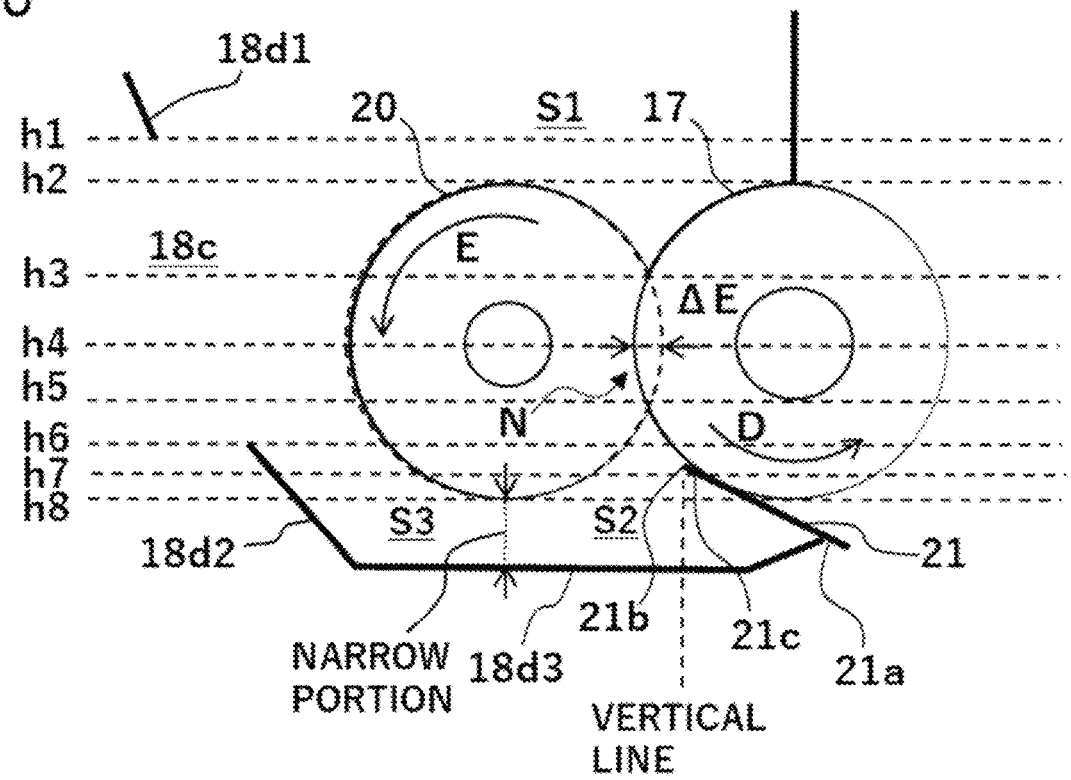
FIG. 8 is an explanatory diagram of an arrangement configuration of the process cartridge according to the embodiment.

Referring to FIG. 8, the details of the arrangement of each member in the developing chamber 18*b* of the present embodiment will be described. FIG. 8 is a schematic cross-sectional view illustrating the positional relationship of each member in the developing device according to the present embodiment.

In the present embodiment, (i) the upper end of the communication port 18*c* that separates the developing chamber 18*b* and the toner accommodating chamber 18*a* (the boundary between the first wall portion 18*d*1 and the communication port 18*c*) is disposed higher than the upper end of the toner supply roller 20. That is, as shown in FIG. 8, a horizontal line h1 passing through the upper end of the communication port 18*c* is located above a horizontal line h2 passing through the upper end of the toner supply roller 20.

Further, (ii) the center of the nip portion N (the center portion in the height direction or a position intersecting with a line connecting the rotation centers of the toner supply roller 20 and the developing roller 17) is disposed higher than the lower end of the communication port 18*c*, and the lower end of the nip portion N is disposed higher than the lower end of the communication port 18*c*. That is, as shown in FIG. 9, a horizontal line h4 passing through the center of the nip portion N is located above a horizontal line h6 passing through the lower end of the communication port 18*c* (the upper end of the second wall portion 18*d*2 (the boundary between the second wall portion 18*d*2 and the communication port 18*c*)). Further, a horizontal line h5 passing through the lower end of the nip portion N is located above the horizontal line h6 passing through the lower end of the communication port 18*c*.

Further, (iii) the lower end of the communication port 18*c* (the upper end of the second wall portion 18*d*2) is disposed higher than the end portion 21*b* at the contact position 21*c* between the developing blade 21 and the developing roller 17 on the upstream side in the rotation direction of the developing roller 17. That is, as shown in FIG. 8, the horizontal line h6 passing through the lower end of the communication port 18*c* (the upper end of the second wall portion 18*d*2) is located higher than a horizontal line h7 passing through the contact position 21*c* of the developing blade 21 and the developing roller 17.

(iv) The upper surface of the third wall portion 18*d*3 among the inner surfaces of the developing chamber 18*b* forming the second space and the third space is arranged as follows. First, a vertical line is drawn with reference to the end portion 21*b* (free end tip) located on the upstream side in the rotation direction of the developing roller 17 with respect to the contact position 21*c* of the developing blade 21 and the developing roller 17 (see FIG. 8). The position of the intersection between this vertical line and the inner surface of the developing chamber 18*b* (the upper surface of the third wall portion 18*d*3) facing the second space is taken as a reference, and the aforementioned surface is disposed to extend substantially horizontally from the reference point toward the third space side, with the narrow portion being interposed therebetween, from a position horizontally spaced from the narrow portion.

(v) The lower end of the communication port 18*c* is disposed higher than the lower end of the toner supply roller 20. That is, as shown in FIG. 9, the horizontal line h6 passing through the lower end of the communication port 18*c* (the upper end of the second wall portion 18*d*2) is located above the horizontal line h8 passing through the lower end of the toner supply roller 20.

Hereinafter, the operational effects of the arrangement configurations (i) to (v) will be described.

(i) Arrangement Relationship between Upper End of Communication Port 18*c* and Upper End of Toner Supply Roller 20

As described above, the main toner supply to the toner supply roller 20 is performed by lifting the toner 40 by the stirring and conveying member 22 and supplying the toner directly above the nip portion N (first space). In the present embodiment, since the upper end of the communication port 18*c* is disposed higher than the upper end of the toner supply roller 20, the toner 40 can be supplied over the toner supply roller 20 to the suction port of the toner supply roller 20 above the nip portion N (first space) (the toner supply roller 20 sucks the toner 40 above the nip portion N because the toner supply roller rotates in the counter direction with respect to the developing roller 17). When the upper end of the communication port 18*c* is disposed lower than the upper end of the toner supply roller 20, the upper end of the communication port 18*c* blocks the toner supply path, and it becomes difficult to supply the toner directly to the space above the nip portion N with the stirring and conveying member 22. Further, in such a case, the toner 40 supplied to the side surface of the toner supply roller 20 is returned toward the toner accommodating chamber 18*a* by the rotation of the toner supply roller 20, and it is sometimes impossible to supply the sufficient amount of toner to the toner supply roller 20.

(ii) Arrangement Relationship between Center of Nip Portion N (Central Portion in Height Direction) and Lower End of Communication Port 18*c*

When the lower end of the communication port 18*c* is higher than the center position of the nip portion N (the height of the central portion in the height direction), the surface of the toner agent accommodated in the second space and the third space in the developing chamber 18*b* is higher than the center of the nip portion N. In such an arrangement, the toner 40 easily enters the nip portion N, and the mechanical stripping force of the toner supply roller 20 with respect to the toner 40 remaining on the developing roller 17 after the developing operation becomes weak. As a result, development streak caused by insufficient stripping can easily occur. Therefore, the position of the lower end of the communication port 18*c* needs to be provided lower at least the upper end of the nip portion N. That is, as shown in FIG. 9, the horizontal line h6 passing through the lower end of the communication port 18*c* is configured to be located below the horizontal line h3 passing through the upper end of the nip portion N. Furthermore, it is desirable that the lower end of the communication port 18*c* be disposed lower than the center position of the nip portion N because the stripping performance of the toner supply roller 20 can be improved. Furthermore, it is desirable that the lower end of the communication port 18*c* be disposed lower than the lower end of the nip portion N because the stripping performance of the toner supply roller 20 can be further improved. That is, as shown in FIG. 9, it is desirable that the horizontal line h6 passing through the lower end of the communication port 18*c* be located below the horizontal line h5 passing through the lower end of the nip portion N.

(iii) Arrangement Relationship between Lower End of Communication Port 18*c* and Tip of Developing Blade 21

The lower end of the communication port 18*c* is disposed at the same level as or higher than the end portion 21*b* at the contact position 21*c* between the developing blade 21 and the developing roller 17 on the upstream side in the rotation direction of the developing roller 17. In this way, the excess toner 40 regulated by the developing blade 21 is continuously supplied to the second space. By doing so, the degree of compaction of the toner 40 in the second space is further increased, and toner supply from the second space to the toner supply roller 20 and the flow of the toner 40 returning from the third space to the toner accommodating chamber 18*a* over the wall portion at the lower end of the communication port 18*c* can be formed. Where the lower end of the communication port 18*c* is lower than the end portion 21*b* on the upstream side in the rotation direction of the developing roller 17 with respect to the contact position 21*c* between the developing blade 21 and the developing roller 17, while other configuration requirements of the present embodiment are being satisfied, it is difficult to increase the degree of compaction in the second space.

(iv) Arrangement Relationship between Tip of Developing Blade 21 and Angle of Inner Wall Portion of Developing Container Further, in order for the toner 40 to move from the second space to the third space, it is necessary to set, as appropriate, the angle of the inner surface of the wall portion of the developing frame 18 (the upper surface of the third wall portion 30*c*) facing the second space and the third space so as not to hinder the movement of the toner 40. Accordingly, in the present embodiment, the inner surface of the wall portion of the developing frame 18 from a position separated in the horizontal direction with respect to the narrow portion is configured to be substantially horizontal from the intersection of the above-described vertical line (see FIG. 9) and the inner surface of the wall portion of the developing frame 18 (the upper surface of the third wall portion 18*d*3). In this way, the toner 40 that has fallen into the second space after being supplied from the toner supply roller 20 to the developing roller 17 and regulated by the developing blade 21 moves toward the third space across the narrow portion.

A configuration may be used in which the toner falls from the second space to the third space (the upper surface of the third wall portion 18*d*3 is inclined) so that the toner is more easily moved from the second space to the third space. By doing so, toner circulation from the second space to the third space can be further promoted.

(v) Arrangement Relationship between Lower End of Communication Port 18*c* and Toner Supply Roller 20

Further, in the configuration of the present embodiment, the lower end of the communication port 18*c* is disposed higher than the lower end of the toner supply roller 20. By doing so, the amount of toner returning from the third space to the toner accommodating chamber 18*a* can be controlled to an appropriate amount, whereby an appropriate compaction space can be formed in the second space.

The developing chamber 18*b* is provided with a developing opening as an opening for carrying the toner 40 to the outside of the developing container 18, and the developing roller 17 is rotatably assembled to the developing container 18 in an arrangement such as to close the developing opening. That is, the toner 40 accommodated in the developing container 18 is borne and conveyed by the rotating developing roller 17 to pass through the developing opening, move to the outside of the developing container 18, and develop the electrostatic latent image on the photosensitive drum 1. At that time, the amount of toner carried out of the developing container 18 is regulated and adjusted by the developing blade 21. The toner accommodating chamber 18*a* is located below the developing chamber 18*b* in the direction of gravity. The position where the developing blade 21 contacts the developing roller 17 is located lower than the rotation center of the developing roller 17 and between the rotation center of the developing roller 17 and the rotation center of the toner supply roller 20 in the horizontal direction.

The stirring and conveying member 22 stirs the toner 40 accommodated in the toner accommodating chamber 18*a* and conveys the toner 40 in the direction of arrow G in the drawing toward the upper portion of the toner supply roller 20 in the developing chamber 18*b*. In the present embodiment, the stirring and conveying member 22 is driven to rotate at a rotational speed of 130 rpm. The developing roller 17 and the photosensitive drum 1 rotate so that the surfaces thereof in the opposing portions move in the same direction (in the present embodiment, the direction from the bottom to the top). Further, in the present embodiment, the developing roller 17 is disposed in contact with the photosensitive drum 1. However, the developing roller 17 may be disposed close to the photosensitive drum 1 with a predetermined gap therebetween. In the present embodiment, the toner 40, which is negatively charged by triboelectric charging with respect to a predetermined DC bias applied to the developing roller 17, is transferred by this potential difference only to the bright section potential portion to visualize the electrostatic latent image in the developing portion that is in contact with the photosensitive drum 1. In the present embodiment, by applying V=−300 V to the developing roller 17, a potential difference ΔV=200 V with the bright section is formed, and a toner image is formed.

Configuration of Developing Blade

The developing blade 21 is disposed to face the counter direction with respect to the rotation of the developing roller 17 and is a member that regulates the amount of toner borne on the developing roller 17. In addition, the toner 40 is imparted with an electric charge as a result of being triboelectrically charged by sliding between the developing blade 21 and the developing roller 17, and at the same time, the layer thickness thereof is regulated. In the developing blade 21, one end portion 21*a* in the short direction perpendicular to the longitudinal direction is fixed to the developing container 18 by a fastener such as a screw, and the other end portion 21*b* is a free end. The direction in which the developing blade 21 extends from the one end 21*a* fixed to the developing container 18 to the other end 21*b* in contact with the developing roller 17 is opposite (counter direction) to the rotation direction of the developing roller 17 in the portion in contact with the developing roller 17.

In the present embodiment, a leaf spring-shaped SUS thin plate having a free length in the short direction of 8 mm and a thickness of 0.08 mm is used as the developing blade 21. Here, the developing blade 21 is not limited to this configuration, and may be a thin metal plate such as phosphor bronze or aluminum.

A predetermined voltage is applied to the developing blade 21 from a blade bias power supply (not shown) to stabilize the toner coat, and V=−500 V is applied as the blade bias.

Figure 3:
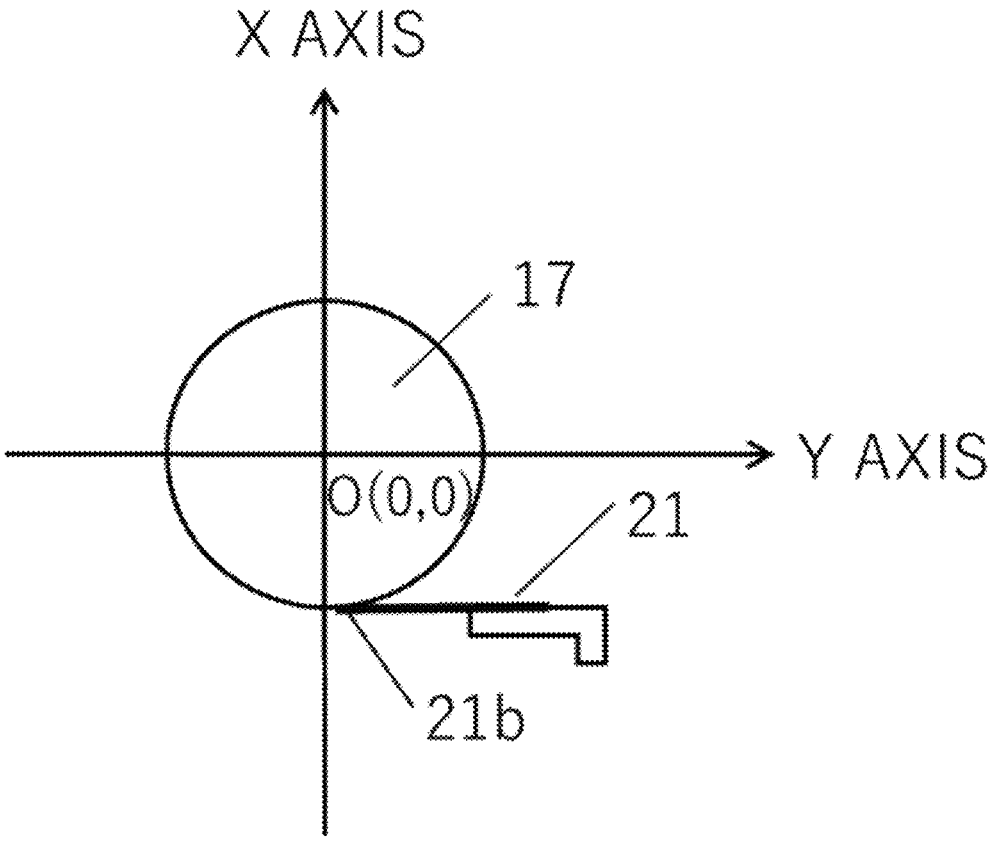
FIG. 3 is an explanatory diagram of the positional relationship between the developing blade and the developing roller in the embodiment.

Here, a method for changing the contact pressure N (gf/mm) of the developing blade 21 against the surface of the developing roller 17 will be described with reference to FIG. 3. FIG. 3 is a schematic diagram for explaining the positional relationship between the developing blade 21 and the developing roller 17. A coordinate system in a cross section perpendicular to the rotational axis of the developing roller 17 as shown in FIG. 3 will be considered. That is, in the cross section, a direction substantially parallel to the direction in which the developing blade 21 extends while being pressed against the developing roller 17 is taken as a y-axis, and a direction perpendicular to the y-axis is taken as an x-axis. This is a coordinate system in which the origin point is the rotation center O of the developing roller 17, and the center coordinates of the developing roller 17 are (x, y)=(0, 0). In this coordinate system, the position of the developing blade tip 21*b* in the x-axis direction is an X value, and the position in the y-axis direction is an Y value. When changing the contact pressure N (gf/mm), the X value and the Y value are changed.

Configuration of Toner Supply Roller

The toner supply roller 20 and the developing roller 17 rotate so that the surfaces thereof move in different directions at the nip portion N where the rollers are in contact with each other. In the present embodiment, the toner supply roller 20 rotates so that the surface thereof moves in a direction at the nip portion N from the lower side toward the upper side, and the developing roller 17 rotates so that the surface thereof moves in a direction at the nip portion N from the upper side toward the lower side. That is, the toner supply roller 20 rotates in the direction of the arrow E (clockwise direction) in the figure and the developing roller 17 rotates in the direction of the arrow D (counterclockwise direction).

The toner supply roller 20 is an elastic sponge roller in which a foam layer is formed on the outer periphery of a conductive metal core. The toner supply roller is made of a flexible material, for example, foamed polyurethane and the like and has a structure that can easily hold the toner in cells having a diameter of 50 μm to 500 μm. Further, the hardness is 50° to 80° (Asker F) and enables uniform contact with the developing roller 17. The resistance value of $1.0\times10^8$ was calculated from a current value obtained when a stainless steel cylindrical member having an outer diameter of 30 mm and the toner supply roller 20 were brought into contact with each other, and a DC voltage of 100 V was applied between the metal core of the toner supply roller 20 and the stainless steel cylindrical member; the measurement environment was 23.0° C. and 50% RH. The toner supply roller 20 and the developing roller 17 rotate at the nip portion N in opposite directions with a circumferential speed difference. With this operation, the toner is supplied to the developing roller 17 by the toner supply roller 20. At that time, the toner supply amount to the developing roller 17 can be adjusted by adjusting the potential difference between the toner supply roller 20 and the developing roller 17.

In the present embodiment, the toner supply roller 20 is driven and rotated at a rotational speed of 700 rpm and the developing roller 17 is driven and rotated at 700 rpm, and a voltage of V=−400 V is applied to the toner supply roller 20 so that the toner supply roller 20 is at Δ−100 V with respect to the developing roller 17. As a result, the toner 40 is easily electrically supplied from the toner supply roller 20 to the developing roller 17.

The rotational speed (rpm) per unit time of the toner supply roller 20 and the developing roller 17 shown herein is an example, and is set, as appropriate, depending on the relative balance of the moving speeds of the respective peripheral surfaces. That is, the rotational speed shown herein is not limiting, provided that in the nip portion N, the peripheral surface of the toner supply roller 20 moves in the direction opposite to the direction in which the peripheral surface of the developing roller 17 moves and from the lower side to the upper side, and that the configuration ensures rotation with the same peripheral speed difference as the configuration of the present embodiment.

Figure 4:
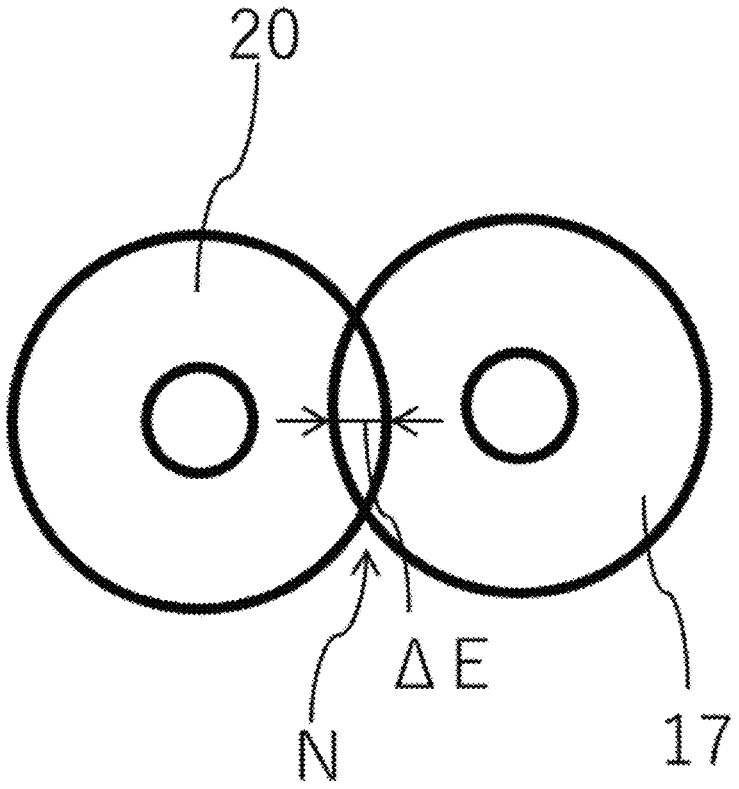
FIG. 4 is an explanatory diagram of the positional relationship between the toner supply roller and the developing roller in the embodiment.

Further, a method for changing the contact pressure D (gf/mm) of the toner supply roller 20 against the surface of the developing roller 17 will be described herein with reference to FIG. 4. FIG. 4 is a schematic diagram for explaining the positional relationship between the toner supply roller 20 and the developing roller 17. As shown in FIG. 4, the toner supply roller 20 and the developing roller 17 are in contact with each other with a predetermined penetration amount, and the toner supply roller 20 has a recess amount ΔE by which the toner supply roller is recessed by the developing roller 17. As shown in FIG. 4, the recess amount ΔE is defined as an overlap amount of the developing roller 17 and the toner supply roller 20 when the two rollers virtually overlap in a state in which contact causes no deformation, as viewed in the rotational axis direction of the developing roller 17 or the toner supply roller 20. Specifically, as shown in FIG. 4, when viewed in the rotational axis direction, the recess amount ΔE is the length of a line segment connecting one point on the outer periphery of the developing roller 17 that has entered the toner supply roller 20 at maximum and one point on the outer periphery of the supply roller 20 that has entered the developing roller 17 at maximum. Alternatively, as viewed in the direction of the rotational axis, the recess amount ΔE is the length of a line segment region intersecting with the line connecting the rotation centers of the toner supply roller 20 and the developing roller 17 in the overlapping portion of the virtually overlapped toner supply roller 20 and the developing roller 17. The contact pressure D (gf/mm) is changed by changing the recess amount ΔE. Both the toner supply roller 20 and the developing roller 17 have an outer diameter of 15 mm. Further, the toner supply roller 20 and the developing roller 17 are arranged so that the center heights are substantially the same.

Method for Measuring Contact Pressure

The measurement of the contact pressure N (gf/mm) of the developing blade 21 against the surface of the developing roller 17 is performed as follows. The developing device from which the developing roller 17 has been removed is mounted on a dedicated measuring jig, and measurement is performed by bringing the developing blade 21 into contact with an aluminum sleeve having the same diameter as the developing roller 17 as a virtual developing roller. The length of the measuring element is 50 mm, and the contact pressure of the toner supply roller 20 is calculated from the average value at two measurement points at both ends and three measurement points at the center.

The measurement of the contact pressure D (gf/mm) of the toner supply roller 20 against the surface of the developing roller 17 is performed as follows. The toner supply roller 20 is mounted on a dedicated measuring jig, and the measurement is performed by bringing the toner supply roller 20 into contact with an aluminum sleeve having the same diameter as the developing roller 17 as a virtual developing roller. The length of the measuring element is 50 mm, and the contact pressure of the toner supply roller 20 is calculated from the average value at two measurement points at both ends and one measurement point at the center.

The measurement of the contact pressure was carried out after the test specimen was allowed to stand overnight in an environment of normal temperature and normal humidity (25° C./50%) and was fully acclimatized to the environment.

Table 1 shows the relationship between the contact pressure D (gf/mm) of the toner supply roller against the surface of the developing roller and the recess amount ΔE by which the toner supply roller is recessed by the developing roller in the present embodiment. Table 2 shows the relationship between the contact pressure N (gf/mm) of the developing blade against the surface of the developing roller and the X value and Y value of the developing blade tip 21*b* in the present embodiment.

TABLE 1

| Recess amount ΔE(mm) | Contact pressure D(gf/mm) |
|---|---|
| 0.4 | 1.5 |
| 0.6 | 2.0 |
| 1.0 | 3.0 |
| 1.2 | 3.5 |
| 1.6 | 4.5 |
| 1.8 | 5.0 |

TABLE 2

| X value(mm) | Y value(mm) | Contact pressure N(gf/mm) |
|---|---|---|
| −5.55 | 0.6 | 1.2 |
| −5.45 | 0.6 | 1.5 |
| −5.40 | 0.6 | 1.7 |
| −5.30 | 0.6 | 2.0 |
| −5.00 | 0.6 | 3.0 |
| −4.70 | 0.6 | 4.0 |
| −4.55 | 0.6 | 4.5 |
| −4.45 | 0.6 | 4.8 |

Toner

Figure 5:
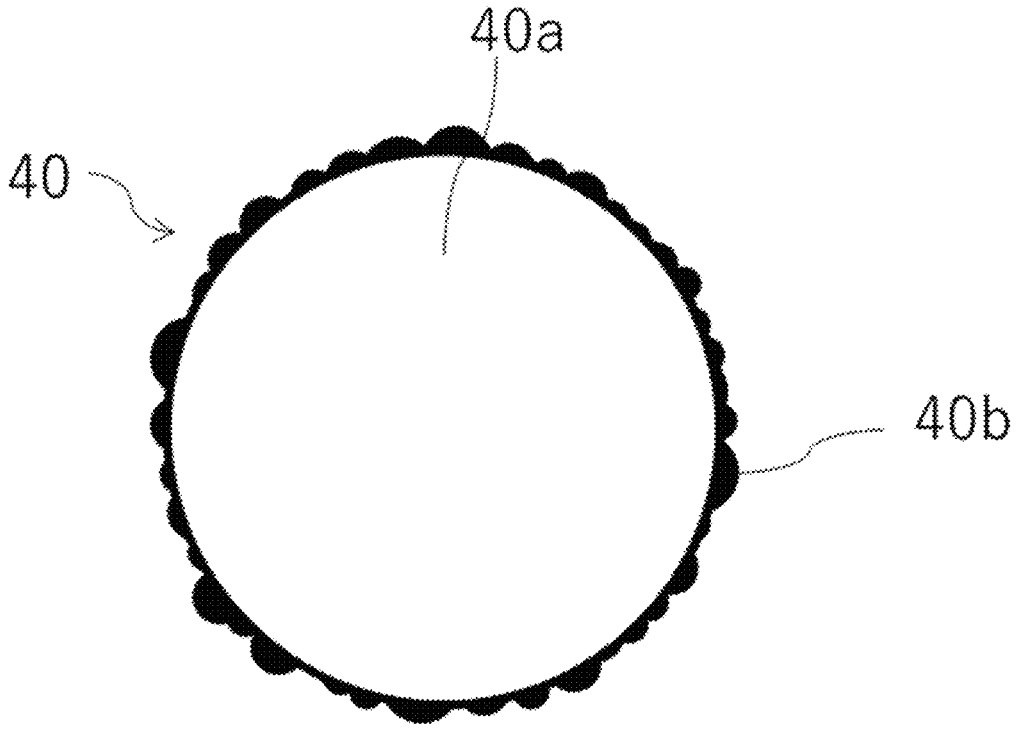
FIG. 5 is a schematic diagram of a toner having a surface layer including an organosilicon compound in the embodiment.

FIG. 5 shows a schematic diagram of the toner 40 used in the present example. In this example, a toner particle having a surface layer 40*b* including an organosilicon polymer is used as the toner base particles 40*a*.

Hereinafter, "parts" of each material is based on mass unless otherwise specified.

Step of Preparing Aqueous Medium 1

A total of 14.0 parts of sodium phosphate (RASA Industries, Ltd., dodecahydrate) was loaded in 1000.0 parts of ion exchanged water in a reaction vessel, and kept at 65° C. for 1.0 h while purging with nitrogen.

An aqueous calcium chloride solution obtained by dissolving 9.2 parts of calcium chloride (dihydrate) in 10.0 parts of ion exchanged water was batch-loaded while stirring at 12,000 rpm using a T. K. Homomixer (manufactured by Tokushu Kika Kogyo Co., Ltd.) to prepare an aqueous medium including a dispersion stabilizer. Furthermore, 10% by mass hydrochloric acid was located in the aqueous medium, and the pH was adjusted to 5.0, whereby an aqueous medium 1 was obtained.

Step of Hydrolyzing Organosilicon Compound for Surface Layer

In a reaction vessel equipped with a stirrer and a thermometer, 60.0 parts of ion exchanged water was weighed and the pH was adjusted to 3.0 using 10% by mass hydrochloric acid. Heating was then performed under stirring to bring the temperature to 70° C. Thereafter, 40.0 parts of methyltriethoxysilane, which was an organosilicon compound for the surface layer, was added and stirring was performed for 2 h or longer to conduct hydrolysis. The end point of the hydrolysis was visually confirmed by the formation of a single layer, without separation, of oil and water, and cooling was performed to obtain a hydrolysate of the organosilicon compound for the surface layer.

Step of Preparing Polymerizable Monomer Composition

| | |
|---|---|
| Styrene | 60.0 parts |
| C.I. Pigment Blue 15:3 | 6.5 parts |

The aforementioned materials were put into an attritor (manufactured by Mitsui Miike Chemical Engineering Machinery, Co., Ltd.), and further dispersed using zirconia particles having a diameter of 1.7 mm at 220 rpm for 5.0 h to prepare a pigment-dispersed solution. The following materials were added to the pigment-dispersed solution.

| | |
|---|---|
| Styrene | 20.0 parts |
| n-Butyl acrylate | 20.0 parts |
| Crosslinking agent (divinylbenzene) | 0.3 parts |
| Saturated polyester resin (Polycondensation product of propylene oxide-modified bisphenol A (2 mol adduct) and terephthalic acid (molar ratio 10:12), glass transition temperature Tg = 68° C., weight average molecular weight Mw = 10,000, molecular weight distribution Mw/Mn = 5.12) | 5.0 parts |
| Fischer-Tropsch wax (melting point 78° C.) | 7.0 parts |

The pigment-dispersed solution to which the above materials were added was kept at 65° C. and uniformly dissolved and dispersed at 500 rpm using a T. K. Homomixer (manufactured by Tokushu Kika Kogyo Co., Ltd.) to prepare a polymerizable monomer composition.

Granulation Step

The polymerizable monomer composition was loaded into the aqueous medium 1 while maintaining the temperature of the aqueous medium 1 at 70° C. and the rotational speed of the T. K. Homomixer at 12,000 rpm, and 9.0 parts of t-butyl peroxypivalate as a polymerization initiator was added. The mixture was granulated for 10 min while maintaining 12,000 rpm of the stirring device.

Polymerization Step

After the granulation step, the stirrer was replaced with a propeller stirring blade and polymerization was performed for 5.0 h while maintaining at 70° C. under stirring at 150 rpm, and then polymerization reaction was carried out by raising the temperature to 85° C. and heating for 2.0 h to obtain core particles. When the pH of the slurry was measured after cooling to 55° C., the pH was 5.0. With the stirring continued at 55° C., 20.0 parts of the hydrolysate of the organosilicon compound for the surface layer was added to start the surface layer formation on the toner particles. After maintaining as is for 30 min, the slurry was adjusted to pH=9.0 for completion of condensation by using an aqueous sodium hydroxide solution and further maintained for 300 min to form a surface layer.

Washing and Drying Step

After completion of the polymerization step, the toner particle slurry was cooled, hydrochloric acid was added to the toner particle slurry to adjust the pH to 1.5 or lower, the slurry was allowed to stand under stirring for 1 h, and then solid-liquid separation was performed with a pressure filter to obtain a toner cake. The toner cake was reslurried with ion exchanged water to obtain a dispersion again, followed by solid-liquid separation with the above-mentioned filter. Resluriying and solid-liquid separation were repeated until the electric conductivity of the filtrate became 5.0 μS/cm or less, and finally solid-liquid separation was performed to obtain a toner cake.

The obtained toner cake was dried with an air flow drier FLASH JET DRIER (manufactured by Seishin Enterprise Co., Ltd.), and fine particles were cut using a multi-division classifier utilizing the Coanda effect to obtain toner particles 1. The drying conditions were a blowing temperature of 90° C. and a dryer outlet temperature of 40° C., and the supply speed of the toner cake was adjusted according to the moisture content of the toner cake so that the outlet temperature did not deviate from 40° C.

In the present embodiment, the obtained toner particles 1 were used as the toner a as they were, without an external additive or the like. Further, toners b to d were prepared by changing the conditions at the time of adding the hydrolysate in the (polymerization step) and the retention time after the addition as shown in Table 3. The pH of the slurry was adjusted with hydrochloric acid and sodium hydroxide aqueous solution.

The toner e was not subjected to the (Step of hydrolyzing organosilicon compound for surface layer). Instead, 15 parts of methyltriethoxysilane as the organosilicon compound for a surface layer was added as a monomer in the (Step of preparing polymerizable monomer composition). In the (Polymerization step), after cooling to 70° C. and measuring the pH, no hydrolysate was added. While the stirring was continued at 70° C., the slurry was adjusted with a sodium hydroxide aqueous solution to pH=9.0 for completion of condensation and maintained for 300 min to form a surface layer. Otherwise, the toner was prepared in the same manner as the toner a.

In the present embodiment, the toilers a to e were used as they were, without external addition, but an external additive may be used.

TABLE 3

| | Number of added parts of polymerization initiator | Number of added parts of crosslinking agent | Type of organosilicon compound for surface layer | Conditions at the time of hydrolysate addition: Slurry pH 0 | Slurry temperature | Number of added parts of hydrolysate | Conditions after addition of hydrolysate: Retention time until pH adjustment for |
|---|---|---|---|---|---|---|---|
| Toner a | 9.0 | 0.3 | Methyltriethoxysilane | 7.0 | 65 | 20 | 3 |
| Toner b | 9.0 | 0.5 | Methyltriethoxysilane | 5.0 | 55 | 20 | 30 |
| Toner c | 9.0 | 0.3 | Methyltriethoxysilane | 5.0 | 40 | 20 | 90 |
| Toner d | 9.0 | 0.3 | Methyltriethoxysilane | 5.0 | 35 | 20 | 150 |
| Toner e | 9.0 | 0.3 | Methyltriethoxysilane | Addition in dissolution step, without hydrolysis | | | |

The measurement of the particle diameter, Martens hardness, and adhesion rate was performed by the methods described in the Description of the Embodiments. The Martens hardness and fixing rate of the toners a to e are shown in Table 4.

TABLE 4

| | Martens hardness at a maximum load of $2.0 \times 10^{-4}$ | Adhesion ratio of organosilicon polymer (%) |
|---|---|---|
| Toner a | 251 | 95 |
| Toner b | 606 | 95 |
| Toner c | 1092 | 96 |
| Toner d | 1200 | 91 |
| Toner e | 185 | 88 |

Contents of Test 1

In the configuration of the present embodiment, the following test was performed.

The contact pressure of the developing blade against the surface of the developing roller was set to 3.5 (gf/mm), the contact pressure of the toner supply roller against the surface of the developing roller was set to 4.0 (gf/mm), and toners a to e were used to evaluate the development streaks, toner charge quantity maintenance performance, density unevenness, and dropout.

As for the evaluation conditions, the toner was allowed to stand overnight in an environment of room temperature and normal humidity (25° C./50%) and was fully acclimatized to the environment. Then, image formation for forming a test image on the recording material was intermittently performed on 10,000 recording materials (durability test), following by the above-described evaluation. In the present embodiment, a horizontal line with an image print percentage of 5% was used as the test image.

The evaluation methods will be described in detail below.

Evaluation of Development Streaks

A halftone image (toner laid-on level: 0.2 mg/cm$^2$) was printed on LETTER size XEROX 4200 paper (manufactured by XEROX Corp., 75 g/m$^2$), and the development streaks were ranked as follows. B or higher was determined as satisfactory.

A: no vertical streak in the paper discharge direction is seen on the developing roller or the image.

B: slight thin streaks in the circumferential direction are seen at both ends of the developing roller, or there are only a few vertical streaks in the paper discharge direction on the image.

C: many streaks are observed on the developing roller, or one or more noticeable streaks or a large number of fine streaks are seen on the image.

Evaluation of Toner Charge Quantity

Figure 6:
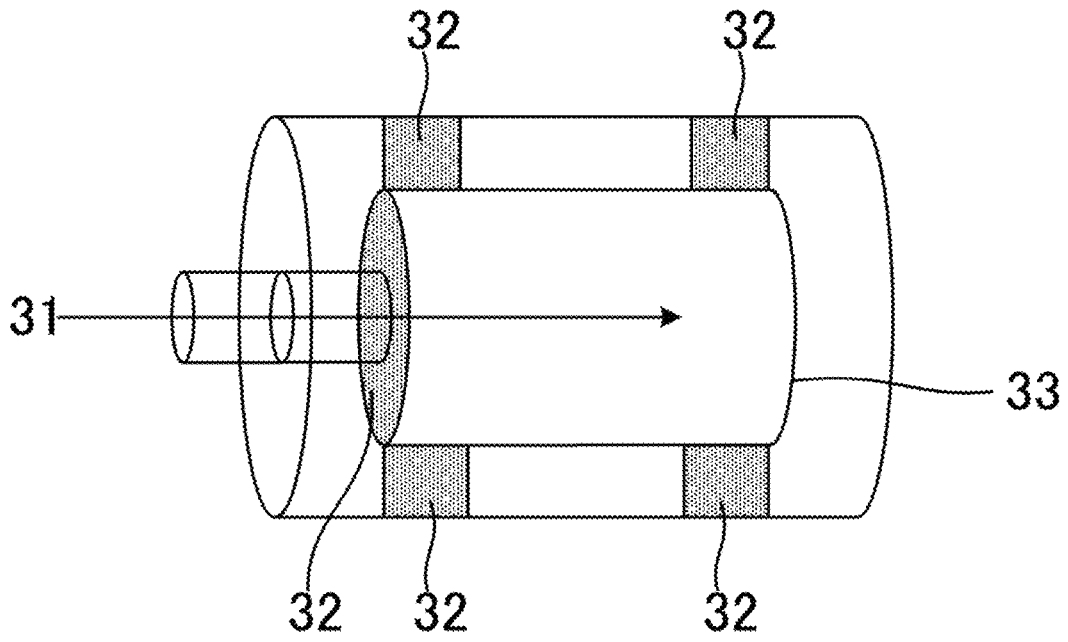
FIG. 6 is an example of a Faraday cage.

A total of 10 solid black images were outputted. The machine was forcibly stopped during the output of the tenth sheet, and the toner charge quantity on the developing roller immediately after passing through the regulating blade was measured. The charge quantity on the developing roller was measured using a Faraday cage shown in the perspective view of FIG. 6. The inside (right side in the figure) was depressurized so that the toner on the developing roller was sucked in, and a toner filter 33 was provided to collect the toner. Here, 31 is a suction part and 32 is a holder. From the mass M of the collected toner and the total charge quantity Q directly measured by a coulomb meter, a charge quantity per unit mass Q/M (μC/g) was calculated and taken as a toner charge quantity (Q/M). The ranking was as follows.

A: less than −35 μC/g

B: at least −35 μC/g and less than −29 μC/g

C: −29 μC/g or more

Evaluation of Density Unevenness

Halftone images (toner laid-on level: 0.2 mg/cm$^2$) were printed on LETTER size XEROX 4200 paper (manufactured by XEROX Corp., 75 g/m$^2$), and density unevenness was ranked as follows. B or higher was determined as satisfactory. The measurement was performed using a spectrodensitometer 500 manufactured by X-Rite.

A: density difference on the image is less than 0.2

B: density difference on the image is at least 0.2 and less than 0.3

C: density difference on the image is 0.3 or more

Evaluation of Dropout

After completion of the durability test, the image forming apparatus was disassembled, and it was investigated whether or not there was a toner dropout on the developing blade. The evaluation was by O and X.

The occurrence of "toner dropout" in this evaluation is a state in which the toner is falling on the developing blade, without being held on the developing roller, in the downstream portion of the developing roller with respect to the toner regulating portion. Where image formation is continued in a state where toner dropout has occurred, contamination in the image forming main body and the recording paper will develop and image quality will deteriorate.

Test Results 1

Table 5 hereinbelow shows the evaluation results of the development streaks, toner charge quantity maintenance performance, and density unevenness in the present embodiment.

TABLE 5

| | Initial stage | After 10,000 prints | | | |
|---|---|---|---|---|---|
| | Charge quantity (μ C/g) | Charge quantity (μC/g) | Development streaks | Density unevenness | Dropout |
| Toner a | −45(A) | −38(A) | A | A | O |
| Toner b | −44(A) | −36(A) | A | A | O |
| Toner c | −45(A) | −40(A) | B | A | O |
| Toner d | −43(A) | −31(B) | C | B | O |
| Toner e | −44(A) | −20(C) | A | C | X |

First, in the configuration of the present embodiment, when the toners a to c were used, the Martens hardness was at least 200 MPa and not more than 1100 MPa, so that the charge quantity could be maintained while suppressing development streaks due to member scraping. Therefore, the occurrence of density unevenness could be suppressed.

When the toner d was used, the Martens hardness was as high as 1200 MPa, so the developing blade and the developing roller were scraped and development streaks occurred. When the toner e was used, the Martens hardness was as low as 185 Mpa, so the toner could not withstand the shear created by the developing blade as the charge imparting member, the toner charge quantity decreased, and density unevenness due to potential unevenness and dropout occurred. Further, with the toner e having a fixing ratio of 90% or less, the organosilicon polymer on the toner particle surface layer is easily peeled off, and the amount of decrease in charge becomes large. Therefore, the fixing ratio is preferably 90% or more.

From these test results, the following was found.

When the contact pressure of the developing blade against the surface of the developing roller was set to 3.5 (gf/mm), the contact pressure of the toner supply roller against the surface of the developing roller was set to 4.0 (gf/mm), and the Martens hardness measured under the condition of a maximum load of toner of $2.0 \times 10^{-4}$ N was set to at least 200

MPa and not more than 1100 MPa, the charge quantity could be maintained while suppressing the development streaks due to member scraping.

Contents of Test 2

In the configuration of the present embodiment, the following test was performed.

Development streaks, density unevenness and dropout were evaluated by somewhat varying the contact pressure N (gf/mm) of the developing blade against the surface of the developing roller and the contact pressure D (gf/mm) of the toner supply roller against the surface of the developing roller and using the toners a and c.

The toner d having a Martens hardness of greater than 1100 Mpa and the toner e having a Martens hardness of less than 200 Mpa were not used because of problems associated with development streaks and tribo maintenance. The toner b was not used because the Martens hardness value was intermediate between those of the toner a and the toner c. Evaluation conditions and evaluation methods were the same as in "Contents of Test 1".

Test Results 2

Figure 7:
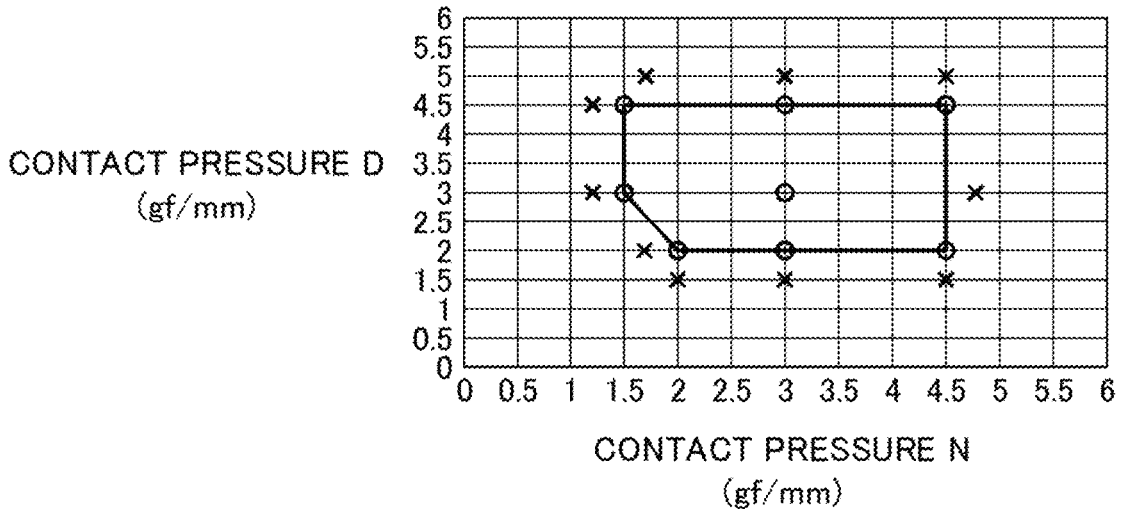
FIG. 7 is a graph showing a range in which density unevenness can be suppressed without image defects.

Tables 6 and 7 show the evaluation results of development streaks and density unevenness in the toners a and c when the contact pressures N and D were varied. In addition, a black line frame in FIG. 7 shows a range in which the high charging performance of the developer can be maintained for a long time without causing image defects and the occurrence of density unevenness due to potential unevenness can be suppressed.

TABLE 6

| | | | After 10,000 prints | | |
|---|---|---|---|---|---|
| | N (gf/mm) | D (gf/mm) | Development streaks | Density unevenness | Dropout |
| Toner a | 2.0 | 2.0 | A | B | O |
| | 4.5 | 2.0 | A | A | O |
| | 1.5 | 3.0 | A | B | O |
| | 1.5 | 4.5 | A | B | O |
| | 4.5 | 4.5 | B | A | O |
| | 3.0 | 4.5 | A | A | O |
| | 3.0 | 3.0 | A | A | O |
| | 3.0 | 2.0 | A | B | O |
| | 2.0 | 1.5 | A | C | O |
| | 4.5 | 1.5 | A | C | O |
| | 1.7 | 2.0 | A | C | O |
| | 1.2 | 3.0 | C | C | X |
| | 4.8 | 3.0 | C | B | O |
| | 1.2 | 4.5 | C | C | X |
| | 1.7 | 5.0 | C | B | O |
| | 4.5 | 5.0 | C | B | O |
| | 3.0 | 5.0 | C | B | O |
| | 3.0 | 1.5 | A | C | O |

TABLE 7

| | | | After 10,000 prints | | |
|---|---|---|---|---|---|
| | N (gf/mm) | D (gf/mm) | Development streaks | Density unevenness | Dropout |
| Toner c | 2.0 | 2.0 | A | B | O |
| | 4.5 | 2.0 | B | A | O |
| | 1.5 | 3.0 | A | B | O |
| | 1.5 | 4.5 | A | B | O |
| | 4.5 | 4.5 | B | A | O |
| | 3.0 | 4.5 | B | A | O |
| | 3.0 | 3.0 | B | A | O |
| | 3.0 | 2.0 | A | B | O |
| | 2.0 | 1.5 | A | C | O |

TABLE 7-continued

| | | After 10,000 prints | | |
|---|---|---|---|---|
| N (gf/mm) | D (gf/mm) | Development streaks | Density unevenness | Dropout |
| 4.5 | 1.5 | A | C | O |
| 1.7 | 2.0 | A | C | O |
| 1.2 | 3.0 | C | C | X |
| 4.8 | 3.0 | C | B | O |
| 1.2 | 4.5 | C | C | X |
| 1.7 | 5.0 | C | B | O |
| 4.5 | 5.0 | C | B | O |
| 3.0 | 5.0 | C | B | O |
| 3.0 | 1.5 | A | C | O |

In the configuration of the present embodiment, where $D+2\times N-6\geq 0$, $1.5\leq N\leq 4.5$, and $2.0\leq D\leq 4.5$, the charge quantity could be maintained while suppressing development streaks due to member scraping.

When $D+2\times N-6<0$, since the shear applied to the toner by the charge imparting member (developing blade) is weak, the toner charge quantity is insufficient and density unevenness due to potential unevenness occurs.

When $N>4.5$ or $D>4.5$, since the shear applied to the toner is too strong, the toner is fused to the toner supply roller or the developing blade, and development streaks occur.

When $D<2.0$, the toner supply amount from the toner supply roller to the developing roller is insufficient, and density unevenness occurs.

When $N<1.5$, the contact pressure of the developing blade against the surface of the developing roller is insufficient, and the dropout occurs. In addition, the toner that has fallen off obstructs the coating on the developing roller, thereby causing development streaks.

From the above results, a toner having a surface layer including an organosilicon polymer and having a Martens hardness of at least 200 MPa and not more than 1100 MPa when measured under the condition of a maximum load of $2.0\times 10^{-4}$ N, and a configuration satisfying the following relationship may be used.

$$D+2\times N-6\geq 0, 1.5\leq N\leq 4.5, \text{ and } 2.0\leq D\leq 4.5$$

Where such a configuration is adopted, it is possible to maintain the high charging performance of the developer for a long period of time without image defects, and to suppress the occurrence of density unevenness due to potential unevenness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213906, filed on Nov. 14, 2018, which is hereby incorporated by reference herein in its entirety.

What is claimed is:

1. A developing device comprising:

a developer bearing member that bears a developer on a surface thereof;

a supplying member that contacts the surface of the developer bearing member and supplies the developer to the surface of the developer bearing member; and a regulating member that contacts the surface of the developer bearing member and regulates the developer borne on the surface of the developer bearing member, wherein the developer includes a toner;

the toner has a Martens hardness of at least 200 MPa and not more than 1100 MPa when measured under a condition of a maximum load of $2.0\times10^{-4}$ N; and wherein a contact pressure of the regulating member against the surface of the developer bearing member is denoted by N (gf/mm) and a contact pressure of the supplying member against the surface of the developer bearing member is denoted by D (gf/mm), the following expressions are satisfied:

$$D+2\times N-6\geq 0,$$

$$1.5\leq N\leq 4.5, \text{ and}$$

$$2.0\leq D\leq 4.5.$$

2. The developing device according to claim 1, wherein the toner has a toner particle;

the toner particle has a surface layer including an organosilicon polymer; and the average number of carbon atoms directly bonded to a silicon atom in the organosilicon polymer is at least 1 and not more than 3 per one silicon atom.

3. The developing device according to claim 2, wherein the fixing ratio of the organosilicon polymer on the surface of the toner particle is 90% or more.

4. The developing device according to claim 2, wherein the organosilicon polymer has a structure represented by a formula (1):

$$R—SiO_{3/2} \qquad \text{Formula (1)}$$

wherein, R represents a hydrocarbon group having at least 1 and not more than 6 carbon atoms.

5. The developing device according to claim 4, wherein the R is a hydrocarbon group having at least 1 and not more than 3 carbon atoms.

6. The developing device according to claim 1, wherein the developer bearing member and the supplying member rotate so that the surface of the developer bearing member and the surface of the supplying member move in different directions with each other at a nip portion where the developer bearing member and the supplying member are in contact.

7. The developing device according to claim 6, wherein in a posture at the time of use, the supplying member rotates so that the surface thereof moves in a direction at the nip portion from a lower side toward an upper side.

8. The developing device according to claim 6, wherein in a posture at the time of use, a position where the regulating member contacts the developer bearing member is lower than a position of the nip portion.

9. The developing device according to claim 1 further comprising:

a frame accommodating the developer, wherein the regulating member is fixed at one end to the frame and contacts the developer bearing member on the other end side which is a free end, and a direction extending from the one end to the other end is a direction opposite to the rotation direction of the developer bearing member at a portion in contact with the developer bearing member.

10. The developing device according to claim 1 further comprising:

a frame accommodating the developer, wherein the frame includes:

a developing chamber in which the developer bearing member, the supplying member and the regulating member are disposed;

an accommodating chamber that is located lower than the developing chamber in a posture at the time of use and stores the developer to be supplied to the developing chamber; and a partition wall portion having a communication port communicating the accommodating chamber and the developing chamber, and wherein the developing device further includes:

a conveying member that is disposed in the accommodating chamber and conveys the developer from the accommodating chamber to the developing chamber through the communication port.

11. The developing device according to claim 10, wherein the position of the upper end of the communication port is higher than the upper end of the supplying member.

12. The developing device according to claim 10, wherein the position of the lower end of the communication port is higher than the lower end of the supplying member.

13. A process cartridge comprising:

the developing device according to claim 1; and an image bearing member for bearing an electrostatic latent image to be developed by the developing device, wherein the process cartridge is capable of being detachably attached to an image forming apparatus.

14. An image forming apparatus comprising:

the developing device according to claim 1; and an image bearing member for bearing an electrostatic latent image to be developed by the developing device.

* * * * *